United States Patent [19]

Endo

[11] 4,299,473

[45] Nov. 10, 1981

[54] ELECTROPHOTOGRAPHIC COPYING MACHINE USING A THICK SHEET OF SMALL SIZE AS A TRANSFER SHEET

[75] Inventor: Koichi Endo, Hachioji, Japan

[73] Assignee: Konishiroku Photo Industry Co., Ltd., Tokyo, Japan

[21] Appl. No.: 941,410

[22] Filed: Sep. 11, 1978

[30] Foreign Application Priority Data

Sep. 14, 1977 [JP] Japan ..... 52-122815[U]
Feb. 18, 1978 [JP] Japan ..... 53-17913

[51] Int. Cl.[3] ..... G03G 15/22

[52] U.S. Cl. ..... 355/3 SH; 355/3 TR; 355/8; 355/14 SH

[58] Field of Search ..... 355/3 SH, 3 TR, 14 SH, 355/14 R, 8; 271/245, 246

[56] References Cited

U.S. PATENT DOCUMENTS 3,963,339 6/1976 Taylor et al. ..... 271/245 X
4,026,647 5/1977 Kanno et al. ..... 355/3 SH
4,136,941 1/1979 Sawaoka ..... 355/8 X
4,139,300 2/1979 Katayama et al. ..... 355/8 X
4,171,901 10/1979 Takizawa et al. ..... 355/8

*Primary Examiner*—William H. Beha, Jr.
*Attorney, Agent, or Firm*—Haseltine and Lake

[57] ABSTRACT

An electrophotographic copying machine in which a thick sheet of small size such as a postcard is used as a transfer sheet. Transfer sheets stored in a tray are fed one after another as the copying operation proceeds, to a treating station such as a transfer section. The transfer sheet is brought into a temporary waiting condition on a carrying means provided in front of a transfer means and is again transported when a stopper provided in connection with the carrying means is retracted from the transportation passage in response to a synchronous signal. The carrying means is brought into its operative condition prior to the retraction of the stopper so that the transfer sheet is again transported at a constant speed.

7 Claims, 21 Drawing Figures

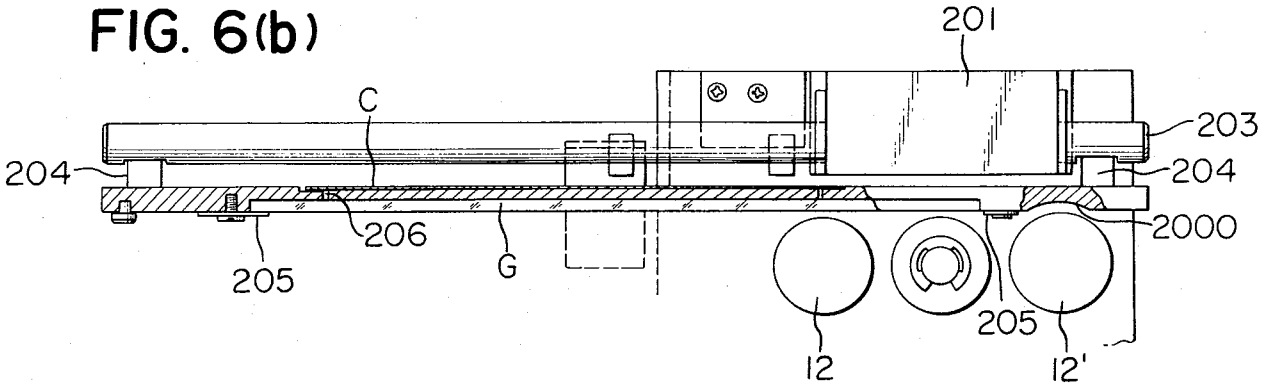
FIG. 6(b)
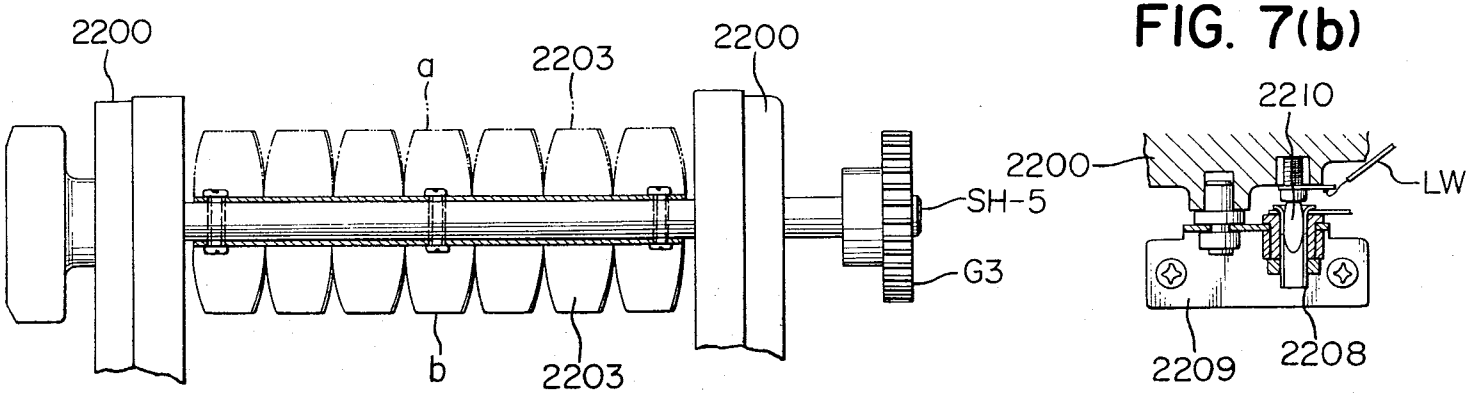
FIG. 7(a)
FIG. 7(b)

ELECTROPHOTOGRAPHIC COPYING MACHINE USING A THICK SHEET OF SMALL SIZE AS A TRANSFER SHEET

BACKGROUND OF THE INVENTION

This invention relates to an improved electrophotographic copying machine and a method of controlling the machine.

An electrophotographic copying machine normally produces a copy through the following processes:

(a) Electrical charging process in which a photoconductive insulating surface (hereinafter referred to as "photosensitive element" or "photosensitive drum") is subjected to corona discharging in order to apply electric charges uniformly on the surface.

(b) Exposure process in which an original to be copied is exposed to light and the light reflected from the original is projected onto the photosensitive element through an optical system including a mirror and a lens. The electrical charges on the photosensitive element are thus converted to a pattern of electrical charges which is an electrostatic latent image corresponding to the original.

(c) Developing process in which a developer consisting of a toner or combination of a toner and a carrier is brought into contact with the area on the photosensitive element on which the pattern of electric charges lies, so that the pattern is converted to a visible image or a toner image.

(d) Transfer process in which the toner image is transferred onto a transfer sheet: for example, plain paper supplied in synchronism with the copying operation, by applying corona discharge to the transfer sheet from the back side thereof while the transfer sheet movingly overlaps with the area of the toner image on the photosensitive element.

(e) Fixing process in which the toner image on the transfer sheet separated from the photosensitive element is heated to melt and fix the toner image onto the transfer sheet.

In connection with the transfer process in the above item (d), using rollers as a sheet supply means is a common practice. Such sheet supply rollers operate in response to a copying operation starting signal—for example, depression of a copying button—and is always kept in contact with the uppermost sheet of the transfer sheets. Conventionally, these rollers are intermittently driven by their exclusive motor.

However, it is not desirable to provide such an exclusive motor for the sheet supply rollers in view of the fact that a small and inexpensive copying machine is desired, because the provision of such an exclusive motor may constitute a factor against the above desire. It is also a drawback that the provision of the exclusive motor causes a complexity of mechanisms involved in the transmission system of the copying machine because of the given worms and worm wheels disposed between the output shaft of the motor and the shaft of the sheet supply roller.

Synchronized control of the transfer sheet in exactly overlapping relation with the area of image on the photosensitive drum will now be described.

Heretofore, a pair of carrying rollers are provided in the passage of movement of a transfer sheet in the position nearer to the sheet supply station that the transfer electrode and are kept stationary until the front edge of the transfer sheet is pinched between the carrying rollers. Then, the carrying rollers are actuated by means of a synchronous signal obtained in association with rotation of the photosensitive drum, to transport the transfer sheet and cause overlapping thereof.

According to this system, the carrying rollers are actuated intermittently and operate to bring the transfer sheet into a temporary waiting condition. It is therefore difficult to control the carrying rollers so that the transfer sheet is transported in the same condition on every occasion of re-transportation thereof. This results in positional shift of the area of an image to be transferred onto the transfer sheet.

It is therefore intended in the present invention to provide an electrophotographic copying machine having no such disadvantages as mentioned above, and a method of controlling the machine.

SUMMARY OF THE INVENTION

It is a principal object of the invention to provide an electrophotographic copying machine in which a sheet supply means is adapted to make intermittent contact with the uppermost or the lowermost sheet of transfer sheets stored in a stacked condition in a tray and is controlled to perform preliminary operation prior to contact with the transfer sheet to assure a constant state of contact therewith whenever the sheet supply means makes contact with the transfer sheet. No exclusive motor is provided as a driving source of the sheet supply means, and a main motor of the copying machine is used therefor.

It is another object of the invention to provide an electrophotographic copying machine in which a copy board in the form of a reciprocating board is maintained at one side thereof with respect to the body of the machine.

It is a further object of the invention to provide an electrophotographic copying machine in which a movable stopper is provided as the means for bringing a transfer sheet into a temporary waiting condition on the carrying means disposed at the side of the tray for transfer sheets rather than the transfer electrode, so as to obtain exact overlapping condition of the transfer sheet with the photosensitive drum.

It is a still a further object of the invention to provide an electrophotographic copying machine which is provided with a toner supply sleeve having a plurality of sealed toner partitions; the sleeve is easy to carry and the toner therein is not subjected to the influence of humidity.

These and other objects and features of the invention will be understood when reference is made to the description of an embodiment given with reference to accompanying drawings:

BRIEF DESCRIPTION OF THE DRAWINGS

FIG. 7 (*a*) is a side view of the stirring blades and FIG. 7 (*b*) shows a structure for applying a bias voltage;

DESCRIPTION OF THE PREFERRED EMBODIMENTS

Figure 1:
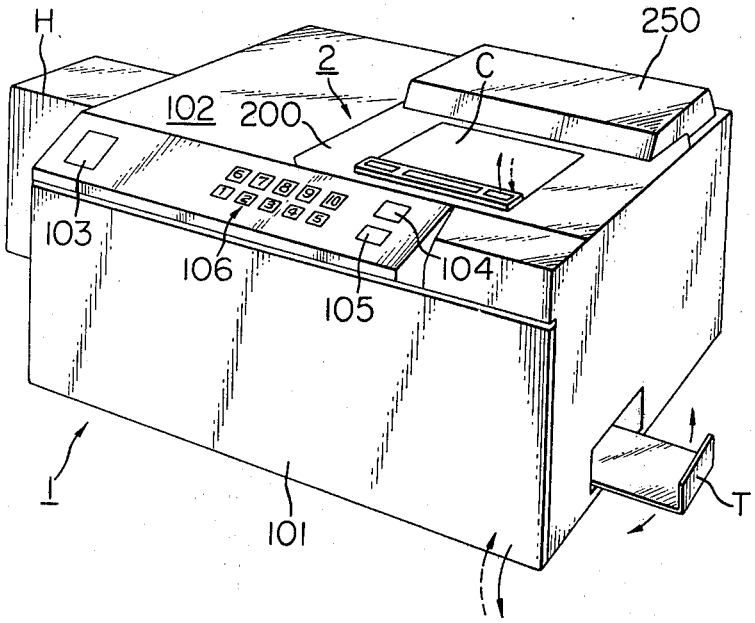
FIG. 1 is a representation of the outer appearance of the copying machine according to the invention.

Referring now to FIG. 1 which is a representation of the outer appearance of an embodiment of a copying machine according to the present invention, reference numeral 1 designates the whole of the copying machine. A front panel 101 is adapted to be opened and closed freely as a fulcrum of its lower edge in connection with a bottom plate 100 (see FIG. 2). A cover 102 in the form of a unitary body constitutes a right hand side, a left hand side, a top side and a part of the front side of the machine. A power switch 103, an indicator means 104 for indicating the time required for a fixing means to be warmed up, and a printing button (copying button) 105 are located in the positions shown on the part of the front side of the machine. A plurality of push buttons 106 made of a light-permeable material are provided for setting the number of printing sheets when a copying operation is desired. Small lamps are located just under the push buttons so that the lamps may be lighted by depression of the buttons to illuminate the particular number on the push buttons. Illumination of the push buttons may be controlled by means of an integrated circuit and such control will be described below in detail. If it is assumed that one of the push buttons 106, for example, the button No. 8, is depressed and then the printing button 105 is depressed to start the printing operation, the number 8 of printing sheets as previously set is memorized and at the same time the small lamp associated with the push button No. 8 is lighted to illuminate the number of the printing sheets. The lamps are also controlled in such a way that they are lighted one by one from the number 1 in sequence for every one of successive copying operations as the copying operation advances. In this embodiment, however, the push button No. 1 is controlled not to be lighted when the number is changed from 1 to 2. As a matter of course, the machine is controlled in such a manner that the copying function of the machine automatically ceases upon completion of the copying cycle in response to a comparison signal from a comparison control circuit (not shown), when the number of copying sheets accords with the number 8 as previously set. Flow of such operation is illustrated in FIG. 3. It is to be noted that in the embodiment shown, the maximum number is 10 and thus the maximum number of copying sheets which can be set is 19. However, improvement is easily possible so that a higher number of copying sheets can be set by providing a push button for the second order. It is because inconvenience inherent to conventional counters of mechanical type or electrical type is removed that the setting number, the printing number and the remains of the recording sheets can be seen at a glance, since the push buttons and the lamps constitute a counter and are controlled to provide an illuminated indication. However, the indication counter system as mentioned above, is not essential to the copying machine of the present invention and, needless to say, a conventional counter system can be employed. In the specification, an assembly of a retaining frame 200 and a mount G (see FIG. 2) made of a transparent glass sheet on which an original is placed is referred to as copy board 2. The copy board 2 is maintained like a cantilever with respect to the machine, but is arranged to move to the right and to the left. An original cover plate C is provided for covering the mount G entirely and is adapted to be lifted up manually in the direction of an arrow as shown in FIG. 1. Retaining means for the copy board 2 is covered by a cover plate 250. Some supply of sheets such as book cards and postcards which are rather thick and of small size (hereinafter referred to as merely "a thick sheet") is stored in a hopper H. A tray T is adapted to move angularly within a given angle in the directions shown by arrows.

Figure 2:
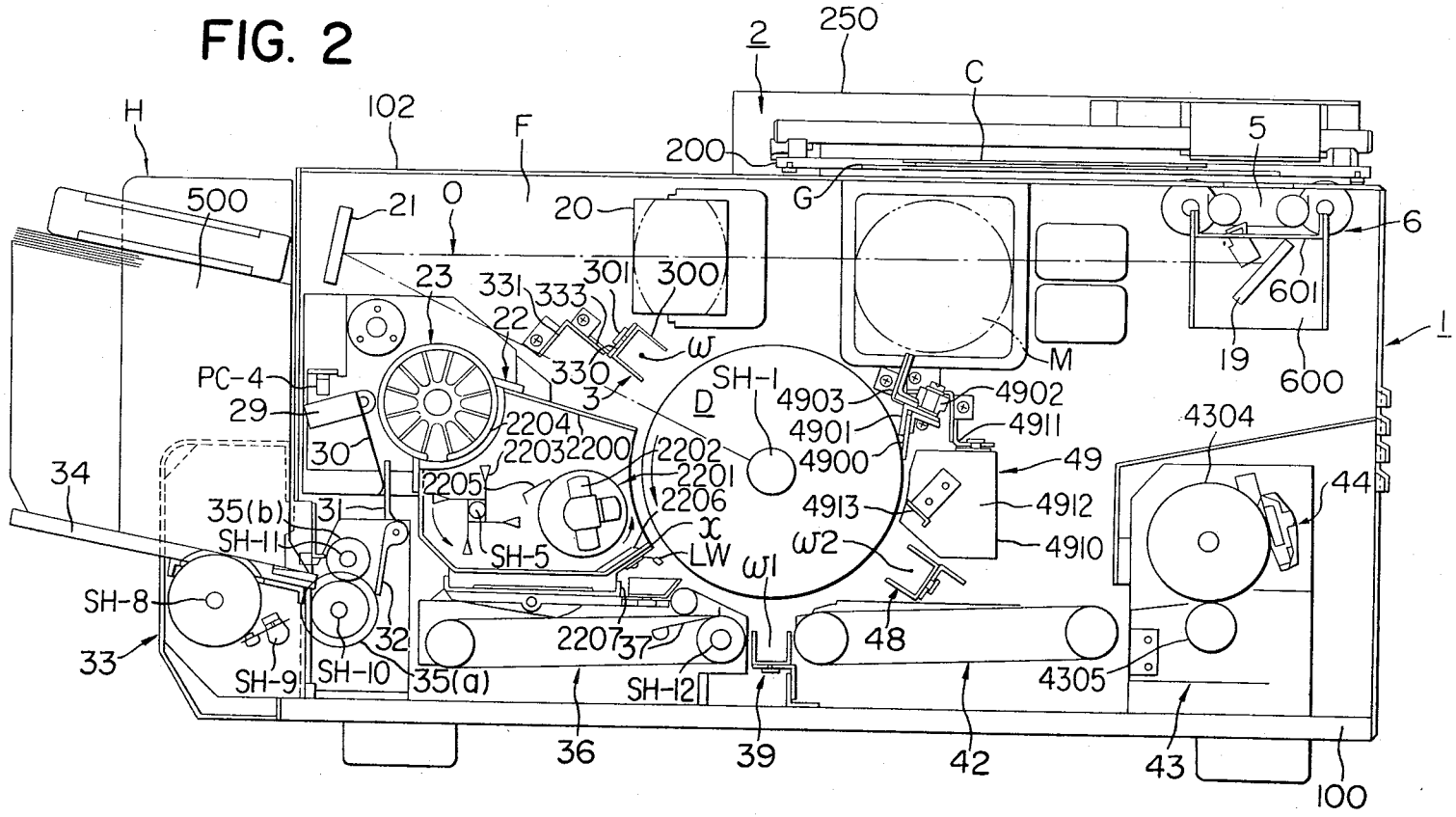
FIG. 2 is a diagrammatical representation of the internal structure of the machine shown in FIG. 1.
Figure 3:
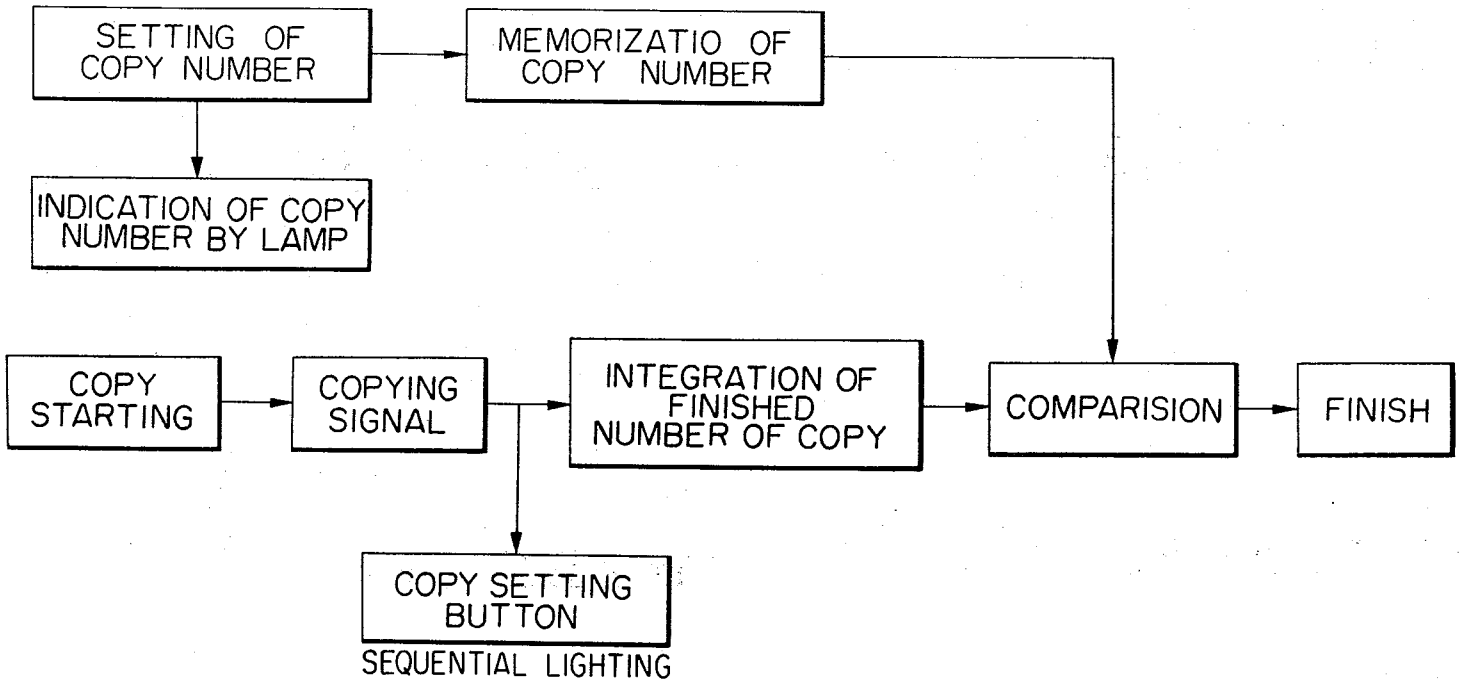
FIG. 3 is a block diagram representative of a counter employed in the machine.

FIG. 2 is a schematic representation of the internal structure of the copying machine shown in FIG. 1. In the drawing, D indicates a hollow photosensitive drum having a photoconductive insulating layer on the surface thereof and detachably mounted on the shaft SH-1 provided on the side of the machine body. In the embodiment, the photosensitive drum is a selenium photosensitive drum having a seamless surface which is usually called a demand type. Mounting of the photosensitive drum D on the shaft SH-1 is effected by fitting in place on the shaft SH-1 a pin studded with a groove provided in the rim portion (not shown, except the place where the drum fits with the shaft) of the rear side of the photosensitive drum D. The shaft SH-1 is rotatably journalled by a frame F. In copying machines of conventional type, a common method of assembly is to position frames to be used for securing various parts and members to the body of the machine parallel to each other at the front side and the rear side of the body of the machine (In FIG. 2, one near side and the other far side) and vertically with respect to the bottom plate of the machine body, whatever shape those frames may take. In the copy machine embodying the invention, however, the frame F is provided only on the far side of the body of the machine. This leads to simplification of the machine and permits rapid treatment of paper jam when it occurs since in the near side of the machine enough space is provided for an operator to have easy access to the machine.

Figure 4:
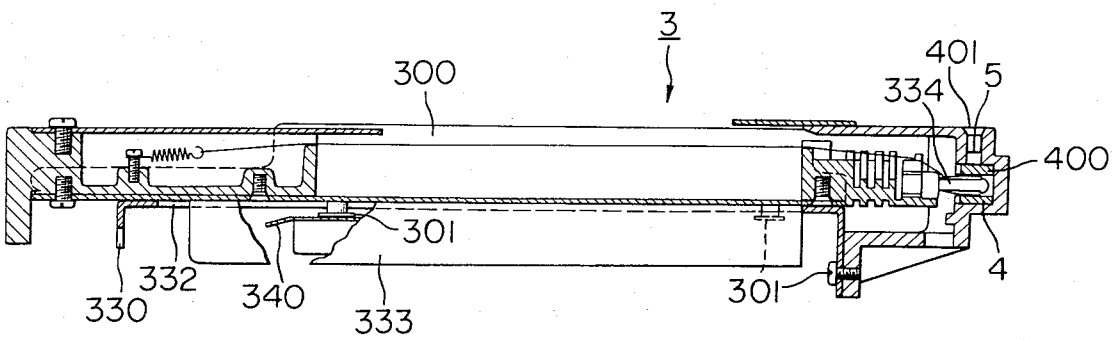
FIG. 4 is a sectional view of a charging device of the machine.

The photosensitive drum D is secured to the shaft SH-1 at the front side thereof in the following manner. A female screw threaded on the front end of the shaft SH-1 is brought into a threaded engagement with a male screw studded on a clamping member also serving as a knob the member has such diameter as to be able to contact with the rim portion of the photosensitive drum on its one end surface. The shaft SH-1 extends through the frame F and has its end coupled to a driving motor M so that the photosensitive drum D is rotated in the direction of an arrow. Driving force is transmitted from the motor to the shaft SH-1 through known power transmission means such as a gear train, a timing gear, a timing belt or the like. A charging device 3 mainly consists of a corona discharge wire w and an electrically conductive shield 300 in the form of a letter "U". On the bottom wall of the shield 300 is studded a stepped pin 301 which slides in a groove 332 of a rail 330 retained like a cantilever on the frame F through a support plate 331 as shown in FIG. 4, and has such function as to hold the charging device 3 in the position shown in FIG. 4. FIG. 4 shows the charging device 3 mounted on the rail 330 and the principal parts thereof are shown in section or in a fragmental manner. The rail 330 is secured to the support plate 331 at its bent portion 333. An electrode 400 is held in an insulating manner by a holding member 4 which is mounted on the side of the machine body and constructed integrally with the rail 330. A lead-in wire 5, one end of which is connected to a high D.C. power source (not shown), is urged onto the electrode 400 by a screw 401. One end of the corona discharge wire w is connected to a plug 334 well-known (as a banana plug) which comes into contact with the electrode 400 when the charging device 3 is mounted on the holding member 4. As a result, an electric path is established between the high D.C. power source and the corona discharge wire w (hereinafter referred to as "wire"). On the nearer side of the bent portion 333 of the rail 330, is provided a pressure plate 340 which makes pressure contact with the pin 301 of the charging device and serves to fix the device without any play. Turning to FIG. 2 again, it is seen that an exposure device is located at the upper part of the right hand side of the machine 1, and under the surface of movement of the copy board 2. A mounting plate 600 is held like a cantilever in the frame F and a supporting body 601 extends a given distance in the direction perpendicular to the mounting plate 600.

Figure 5A:
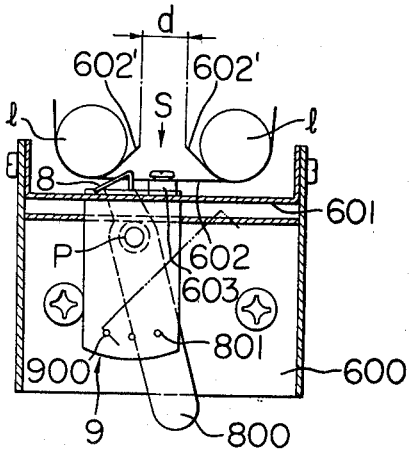
FIG. 5 shows the structure of an exposure device of the machine in section; specifically, FIG. 5 (*a*) is a front view of the structure, FIG. 5 (*b*) is a top view of the structure and FIG. 5 (*c*) is a side view of the structure partially in section.
Figure 5B:
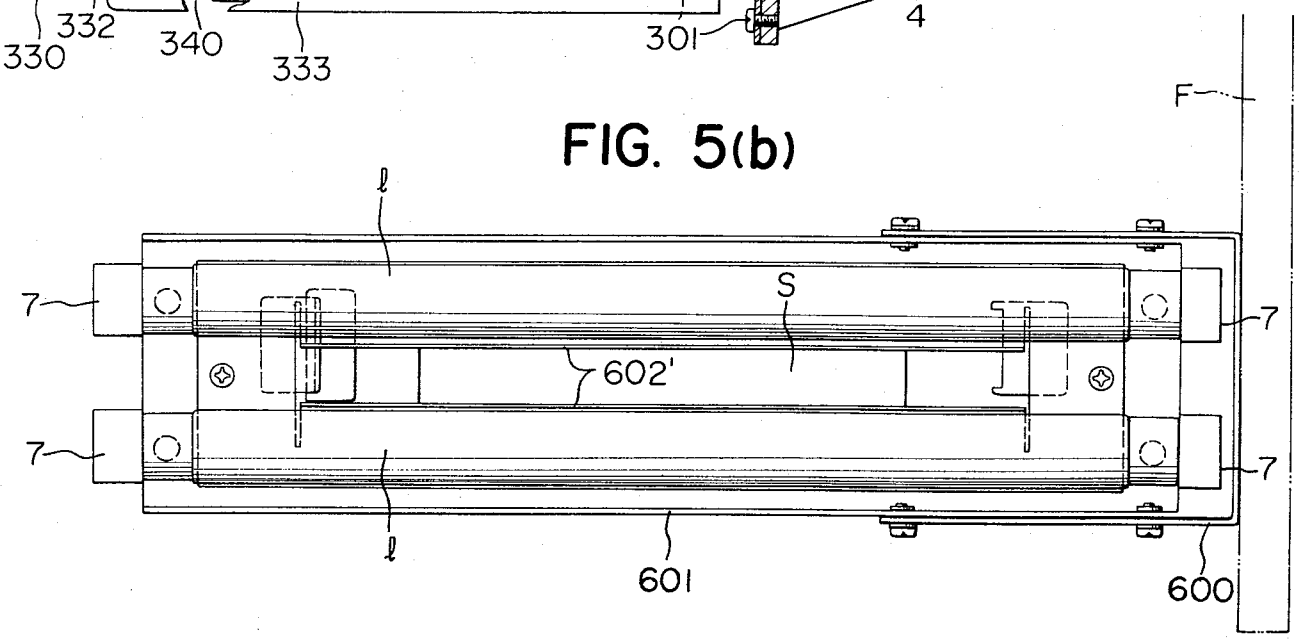
Figure 5C:
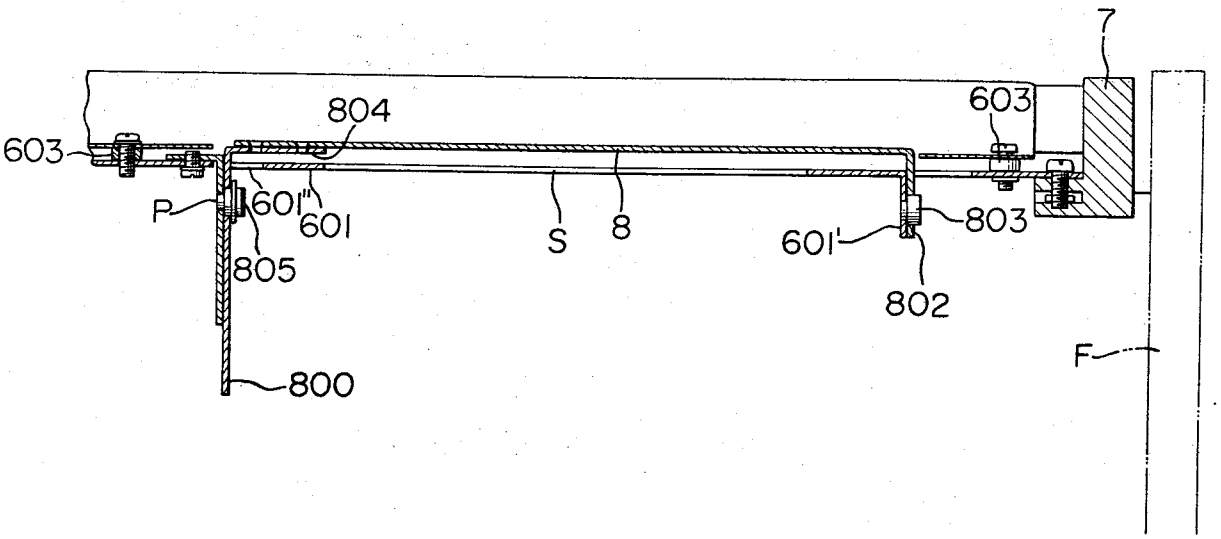
Figure 6A:
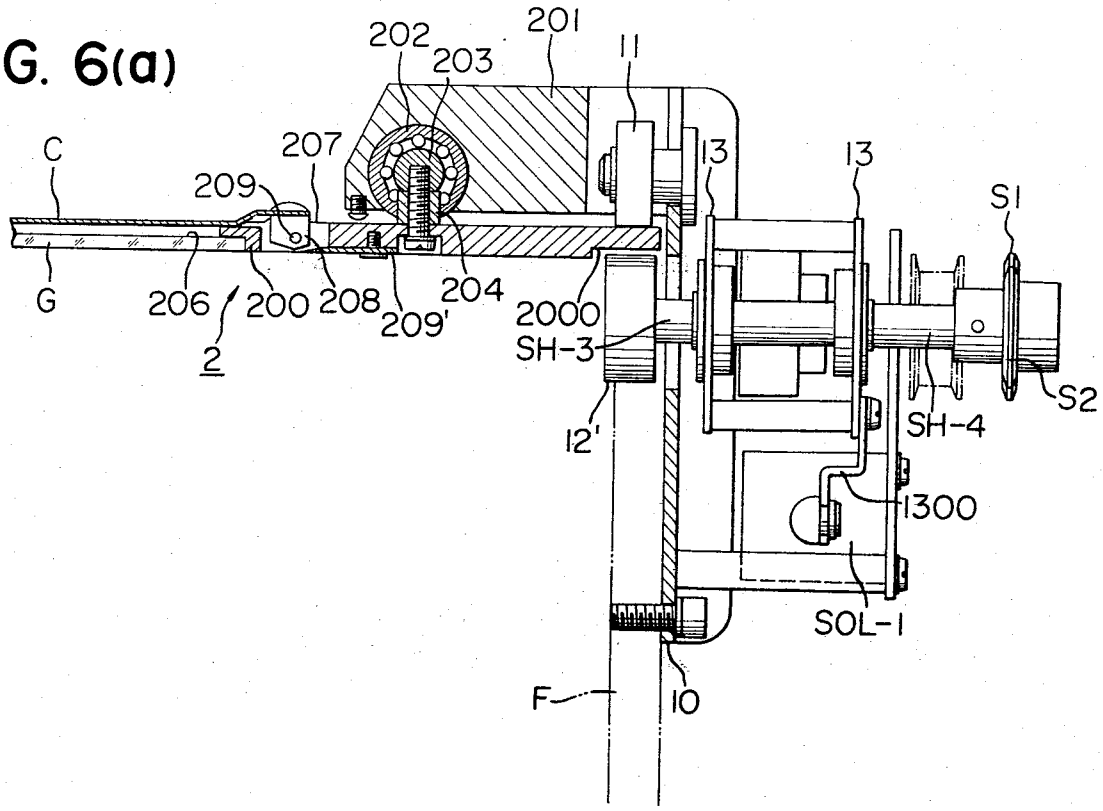
FIG. 6 shows the structure of a copy board; specifically FIG. 6 (*a*) is a side view of the structure partially in section, FIG. 6 (*b*) is a front view of the structure partially in section, FIG. 6 (*c*) is a back view of the structure, FIG. 6 (*d*) is a sectional top view of a driving mechanism for the copy board, and FIG. 6 (*e*) shows the positional relation of the copy board and its control means.
Figure 6C:
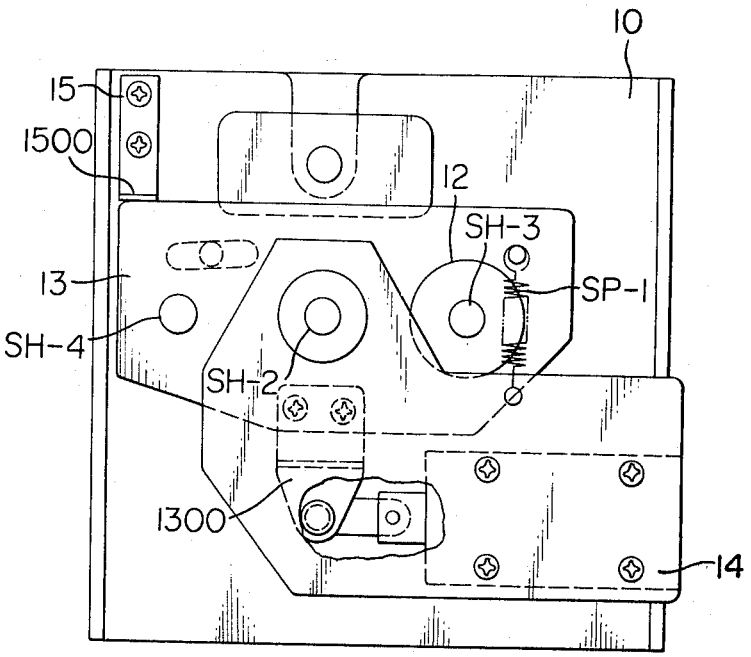
Figure 6D:
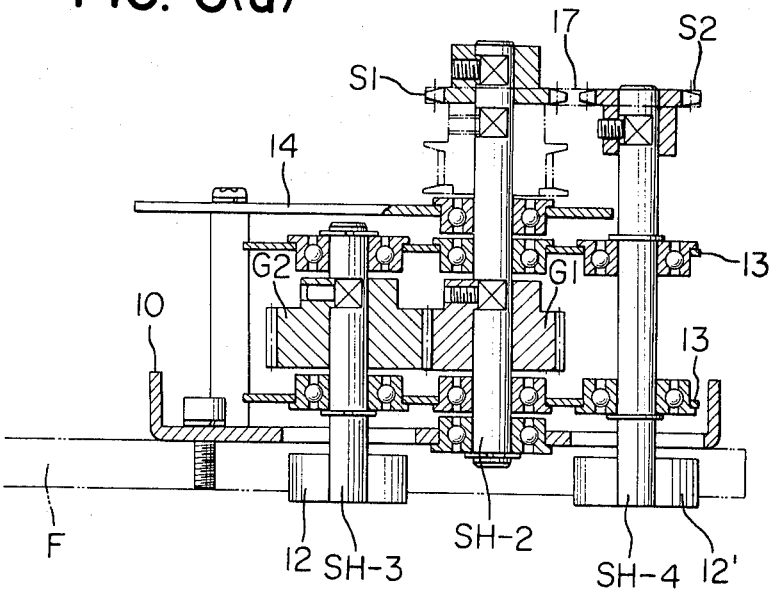
Figure 6E:
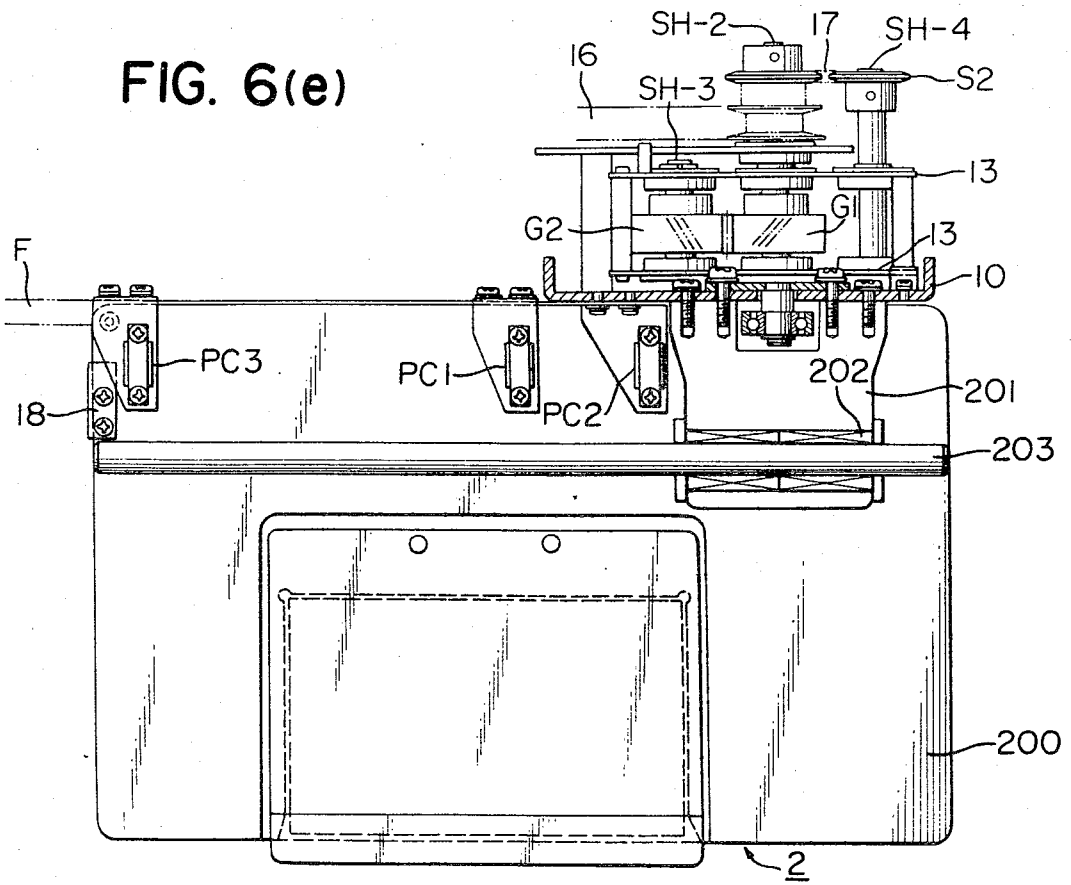

Reference is now made to FIG. 5 for a concrete description of the structure of the machine.

The supporting plate 601 is in the form of the letter "U" and is provided at its center with a slit opening S (hereinafter referred to as merely "slit S"). A light source l for exposure of an original to be copied consists of a pair of fluorescent lamps disposed on the slit S, in parallel to each other. The light source l is held by a holding member 602 fixed to the supporting body 601 through a spacer 603; and the holding member 602 may be made of, for example, a sheet of stainless steel having elasticity. The holding member 602 is punched out at its central portion which opposes the slit S of the supporting plate 601, and is bent at the portion a fixed distance apart from the center thereof to provide a light source holding portion 602'. As seen in the drawing, the light source l of the lamp wall is closely connected at this part with the holding member 602. The lamp needs no additional support and this results in simplification of structure. There is a fear that such a holding method is subjected to various adverse effects caused by adhesion of mercury onto the wall of the lamp; for example, shortening of the life of the lamp and abnormal change or degradation of light distribution. This problem is, solved, however, by selecting the material of the holding member 602 and thickness thereof so that the temperature of the holding member 602 thus selected will rise rapidly by means of the heat caused by radiation of light from the light source l. It is easily possible to arrange the light source l for exposure apart from the holding member 602. In FIGS. 5 (*b*) and 5 (*c*), there is shown a socket 7. A means 8 for adjusting the amount of light (hereinafter referred to as "adjusting means") is provided in association with the slit S so that the width d of the slit S can be adjusted appropriately so as to adjust the amount of light impinged on the photosensitive drum D. A lever 800 is provided for swinging or turning the adjusting means 8 about the point P as a fulcrum. There is a click 801 provided on the lever 800 and the click 801 is in engagement with one of a plurality of holes 900 formed in a setting board 9 as shown in FIG. 5 (*a*).

Relationships of these various members will be clear in FIG. 5 (*c*). The supporting plate 601 is punched out on its appropriate sides, and on its remaining side it is provided with a bent hanging portion 601'. The setting board 9 is fixed on the supporting board 601 in such a manner that a part thereof protrudes beyond a small opening 601'' formed on the side opposite the hanging portion 601' with the slit S positioned intermediately there-between. The bent portion 802 on one end of the adjusting means 8 is rotatably attached on the hanging portion 601' by means of a pin 803. The other end of the adjusting means 8 is secured to one end 804 of the lever 800 which is in turn rotatably attached by its appropriate part to the setting board 9 by means of the pin 805. It is needless to explain that a plurality of holes formed on the setting board 9 is positioned on a locus or the clicks 801 on the lever 800 when the lever 800 is turned about the point as a fulcrum. In the embodiment, the lever 800 and the adjusting member 8 are constituted by separate members; however, it is a matter of design whether they are made in the form of a body or not.

With the structure as above mentioned, if reducing the amount of light is desired, the lever 800 may be turned to the left or clockwise around the fulcrum p to cause the adjusting means 8 to cover the slit S gradually, thereby attaining this object.

Explanation will now be given of the copy board 2 which has already been outlined with reference to FIG. 1 and a mechanism for holding the copy board and a power transmission mechanism for the same. FIG. 6 (*a*) is a sectional view of the principal parts shown in FIG. 2 as viewed from the right hand side thereof, FIGS. 6 (*b*) and 6 (*c*) are a left hand side view and a right hand side view of FIG. 6 (*a*), respectively, and FIG. 6 (*d*) is a sectional top view of only the power transmission mechanism shown in FIG. 6 (*c*). The same components as those in FIG. 2 are indicated by the same reference numerals. There is a support body 201, one end of which is fixed to the mounting plate 10 secured to the frame F and which has a slide bearing 202 on the part extending above a holding frame 200. A guide shaft 203 is fitted in the slide bearing 202, permitting relative movement of the copy board 2, and is supported on the holding frame 200 through a strut 204. The copy board 2, mainly consisting of the original mount G and the holding frame 200, is held like a cantilever and is maintained a little distance from the upper face of the cover 102 facing the copy board 2. The original mount G is fixed to a given position of the holding frame 200 by a clamping plate 205 as shown in FIG. 6 (*b*). There are four such clamping plates 205 at the opposite sides of the copy board 2. On the three sides of the original mount G is provided the holding frame 200 and no holding frame is provided on the one remaining side that is the near side of the machine body in FIG. 2 (the left hand side of the copy board 2 shown in FIG. 6 (*a*)). A step 206 is formed between the upper face of the original mount G and the upper face of the holding frame 200. Such a way of holding the original mount G by the provision of the step 206 is intended to expedite loading and unloading of the original and cleaning of the original mount G. Positioning of the original to be copied is also taken into consideration. It is preferred that the side of the original mount G which has no holding frame is slightly and gradually inclined upwards as viewed from the lateral side of the orignal mount G. It is desirable to provide the above-mentioned step on the two adjacent sides of the original mount G. An appropriate number of openings 207 are formed to accommodate retaining members 208 of the original cover plate C. The original cover plate C can be lifted up with a pin 209 associated with the holding frame 200 to serve as a fulcrum. An elastic plate 209' is provided in contact with the lower side of the retaining member 208. Pressure rollers 11 are mounted on the mounting plate 10 for rotary movement and have their lower portions in contact with the upper side of the holding frame 200. The pressure rollers 11 serve to keep horizontal the plane of the copy board 2 which tends to turn with respect to the guide shaft 203, and to assure that the copy board 2 moves parallel and smoothly.

Referring to FIGS. 6 (*b*) and 6 (*d*), there are provided under the lower side of the holding frame 200 (partially shown in section as 2000) a pair of driving rollers 12, 12' mounted on rotation shafts SH-3 and SH-4 for transmitting mechanical power to the holding frame 200 to move the copy board 2 back and forth. These driving rollers 12 and 12' are used to move the copy board 2 forward and backward respectively, and are associated with a selenoid SOL-1 through the plates 13 and 1300 so that the rollers alternatively make contact with the lower side of the holding frame during copying operation of the machine. The center of the turning movement of the rollers 12, 12' is on the shaft SH-2. The driving rollers 12, 12' drive the copy board 2 by means of frictional force caused by their contact with the holding frame 200 and it is desirable to employ a rubber roller having as large a coefficient of friction as the rollers 12, 12'. A spring SP-1 is provided between the plate 13 and the outer plate 14 fixed to the frame F, and is always energized to turn the plate 13 clockwise in FIG. 6 (*c*) so as to bring the roller 12' for backward movement into contact with the above-mentioned place on the holding frame 200. A control plate 15 is provided for directing excessive pressure of the roller 12' onto the holding frame 200, due to the biasing force of the spring SP-1; and the bent portion 1500 of the control plate 15 abuts on a part of the plate 13. A sprocket S2 is located on one side of the shaft SH-4. The shaft SH-2 is coupled to the driving source or the motor M shown in FIG. 2 by means of a timing belt 16 shown by a two-dot chain line. Rotating power source of the shaft SH-2 is transmitted to the driving roller 12' for backward movement through a chain 17 coupling the sprocket S1 to a sprocket S2 fixedly mounted on the shaft SH-4, and also to the other driving roller 12 through gears G1 and G2. It is desirable that these gears G1 and G2 be bevel gears as shown in FIG. 6 (*e*). This is required to obtain pictures with no blur. The timing belt may be replaced by a steel rope used in the prior art device.

Operation of the machine with the above-mentioned structure will now be described.

When a printing button 105 is depressed, the motor M starts its rotation with the result that the mechanical power causes the driving roller 12 to rotate through the shaft SH-2, the gears G1 and G2, and the driving roller 12' to rotate through the shaft SH-2, the sprocket S1, the chain 17, and the sprocket S2. However, the electrical circuit is so arranged that the solenoid SOL-1 is energized simultaneously with the depression of the printing button 105 and the plate 13 is turned counterclockwise against the biasing force of the spring SP-1, so that the roller 12' for backward movement will move apart from the holding member 200. On the other hand, the roller 12 for forward movement will make contact with the lower side of the holding member, thereby causing the copy board 2 to move to the right in FIG. 2 by means of the frictional force. When the original mount G reaches above the light source l for exposure, the original (not shown) on the original mount G is subjected to radiation from the light source l. The light reflected from the original caused by illumination of the light source l is conducted through a familiar optical system onto the photosensitive drum D.

Referring to FIG. 6 (*e*), a detection means consisting of, for example, photo-couplers PC1, PC2, and PC3, is so arranged on a proper support member that they are positioned on the copy board 2 (actually on one side of the holding frame 200) and there is a piece of member 18 so arranged on the end of the holding frame 200, that the member 18 is passed under the detection means PC1, PC2, and PC3 when the copy board 2 is moved. The member 18 is detected by any of these detection means PC1, PC2, and PC3. When the detection means PC1 detects the member 18 moving with the copy board 2, a stopper 37 arranged within the area of the first carrying means is retracted from the carrying path of a transfer sheet in response to the signal generated by the detection means PC1. When the detection means PC2 detects the member 18, electrical connection is made so that the solenoid SOL-1 is de-energized so as to change the movement of the copy board 2 from forwards to backwards. In the embodiment, arrangement is made so that, in case of successive copying operations, a sheet supply means 33 is energized in response to the signal of the detection means PC2 to feed a transfer sheet stored in the hopper H. The detection means PC3 serves to detect the return of the copy board 2 to its initial position and to de-energize the motor M several seconds later. Though the roller 12' continues to rotate until the motor M stops, the roller 12' is located at the side of the frame F with respect to the cut surface 2000 and therefore the mechanical power is not transmitted to the holding frame 200. In case of successive copying operations, the energizing circuit of the motor M contains itself by a known method. Relation of the detection means PC2, PC3, the sheet supply means 33, and the stopper will be described in detail hereinafter. It is to be noted that the slide bearing 202 and the guide shaft 203 may be replaced by a cantilever holding the copy board 2. Since a main feature of the invention lies in the direct coupling of the sheet supply means 33 to the driving source or the motor M, it is to be understood that a well-known structure of and a well-known driving control for the copy board 2 may be employed.

Turning to FIG. 2 again, there are provided between the copy board 2 and the photosensitive drum D a first mirror 19, a lens 20, and a second mirror 21 for projecting the light reflected from the original onto the photosensitive drum D as mentioned hereinbefore. The three components are referred to as a so-called optical system. The first mirror 19 is located under the slit S of the exposure device and inclined at a given angle with respect to the optical axis 0. The second mirror 21 is also inclined at an appropriate angle with respect to the optical axis 0. A developing means 22 is provided for visualizing a pattern of electric charges (electrostatic latent image) corresponding to the original to be copied and formed on the photosensitive drum D by the action of the charging device 3 and the exposure device 6. In the embodiment shown in FIG. 2, a developing device of magnetic brush type is employed. The developing device 22 mainly consists of: a housing 2200, including a bottom for accommodating a developer—consisting of, for example particles of magnetic material (hereinafter referred to as "carrier") and pulverized toner (hereinafter referred to as "toner")—and an opening opposite the photosensitive drum D; a means for forming a developer flowing path, including a sleeve 2201 arranged to circulate the developer and a plurality of permanent magnets 2202 with their different poles arranged alternately; and stirring blades 2203. The housing 2200 is provided on its part with a recess 2204 which allows a part of a toner supply container 23 to be housed therein. The sleeve 2201 is formed of a non-magnetic and electrically conductive material and is controlled to be rotatable in the direction of an arrow in a known manner. In the embodiment, the power transmission mechanism for the sleeve is directly coupled to the motor M. The permanent magnets 2202 are arranged over the required area along the inner periphery of the sleeve. As a matter of fact, there is a gap between the outer end of each of the permanent magnets 2202 and the internal periphery of the sleeve 2201.

A scraper 2205 is provided longitudinally of the sleeve 2201 so that one end of the scraper is able to make contact with the outer periphery of the sleeve 2201 or is positioned in the vicinity thereof. It is known that the scraper 2205 serves to scrape the developer carried by the sleeve while being attracted by the magnetic action after accomplishment of the developing function, and constitutes a component for constantly supplying the sleeve with developer of a uniform mixture ratio. The stirring blades 2203 are positioned on a rotatable shaft SH-5 so that parts of the stirring blades 2203 are immersed in the developer (not shown) accommodated in the housing 2200 and are positioned so as to receive or to make contact with the developer falling down after it is scraped from the surface of the sleeve. The stirring blades 2203 are arranged on the shaft SH-5 at 90 degrees angularly apart from each other, and each stirring blade is divided into a plurality of blade pieces as shown in FIG. 7 (*a*) where all are twisted in the same direction. In the drawing, the stirring blade a shown by a two-dot chain line is positioned at right angles to the stirring blade b shown by a solid line. This is intended to imply that the stirring blades 2203 shown in FIG. 2 are each twisted in opposite directions to each other. The reason why the stirring blades 2203 are constructed as above-mentioned is to ensure that the developer scraped by and falling along the scraper 2205 is forced aside longitudinally of the stirring blades alternately by the stirring blades of different angles of 90 degrees so that the amount of developer is kept substantially constant along the longitudinal direction of the sleeve 2201, thereby assuring a sufficient mixing and stirring function. On one end of the shaft SH-5 is fixedly mounted a gear G3 which is in mesh with a gear (not shown) on the rotating shaft united with the sleeve 2201. This means that the stirring blades 2203 are rotated in the direction of an arrow as the sleeve 2201 rotates. A restraining member 2206 is provided slantwise on the bottom of the housing 2200 opposite to a part of the periphery of the sleeve 2201. The restraining member 2206 extends longitudinally of the sleeve 2201 and has a desired width as shown in FIG. 2. The function of this restraining member 2206 is to limit the amount of developer (or the thickness of the developer layer on the surface of the sleeve which is usually called "the amount of ear of the developer") attracted onto the sleeve 2201 by the magnetic action when the sleeve is rotated. The restraining member 2206 is disposed inside the housing 2200 for the following reasons. In conventional copying machines, an ear restraining plate is usually formed of either a part of the housing bent inwardly at the position marked x in FIG. 2, which part defines the lowermost edge of the opening of the housing opposed to the photosensitive drum, or an additional member attached to this particular position of the housing. However, with the restraining plate located in the border of the outside space, the restraining member is subjected to considerable pressure or strike by the developer existing on the sleeve due to rotation of the sleeve, and pulverized toner and carrier may be scattered towards the outside, with the result that the inside of the machine will be soiled and some of the components adversely affected. Another drawback is that excessive developer is scraped forcibly by the restraining plate 2205, and the surface of the developer layer attached to the sleeve after being restrained by the restraining plate is remarkably uneven and a copied picture will be subjected to a delicate influence thereby. The invention takes such a phenomenon into serious consideration and proposes the restraining member as above-described with the view towards avoiding hasty scraping of the toner and scattering thereof. It is of course possible to modify or change the shape and position of the restraining member 2202 so as to obtain the effects as mentioned above. In the embodiment according to the invention, the restraining member 2206 is formed of an electrically conductive material such as aluminum plate and also functions as an electrode for applying a known biasing voltage for the purpose of removing the blur on a copied picture. The electrical path intended for application of the biasing voltage can easily be established by an electrode 2208, which is connected to a D.C. voltage source and secured to a support plate 2209 at the rear side of a rail 2207 for setting the developing device 22 in a given position of the machine, and a terminal 2210 mounted on the housing 2200 (exactly the rear side plate) for connection to the electrode 2208. The terminal 2210 is electrically connected to the restraining member 2206 (refer to FIG. 2) by a lead-in wire LW, when the developing device 22 is set in place in the machine. Needless to say, electrical safety against application of the biasing voltage is assured.

With the structure of the machine as described above, when the sleeve 2201 rotates, the developer accumulated on the bottom of the developing device under the influence of the magnetic action of the permanent magnet 2202 is attracted onto the sleeve, and the amount of developer is controlled by the restraining member 2206 and carried along the surface thereof in a stable condition. Then the developer thus limited rubs the surface of the photosensitive drum D to convert the pattern of the electric charges on the drum to a toner image. The developer is scraped from the surface of the sleeve by the scraper 2205 after the conclusion of the developing action and falls down along the scraper 2205. The developer falls down from the scraper onto the stirring blades 2203 and is forced aside longitudinally of the sleeve by the stirring blades, twisted in opposite directions to each other, while the developer is mixed and stirred. The developer is circulated as above explained, and thus the developer adhered to one particular area of the sleeve 2201 will change its area of adhesion when the developer adheres to the sleeve again. It is therefore possible to obtain a developed picture of good quality all the time, even if a number of originals having different densities are copied.

Explanation will be given of the structure of the toner supply container and the toner supplying mechanism by reference to FIG. 8.

Figure 8A:
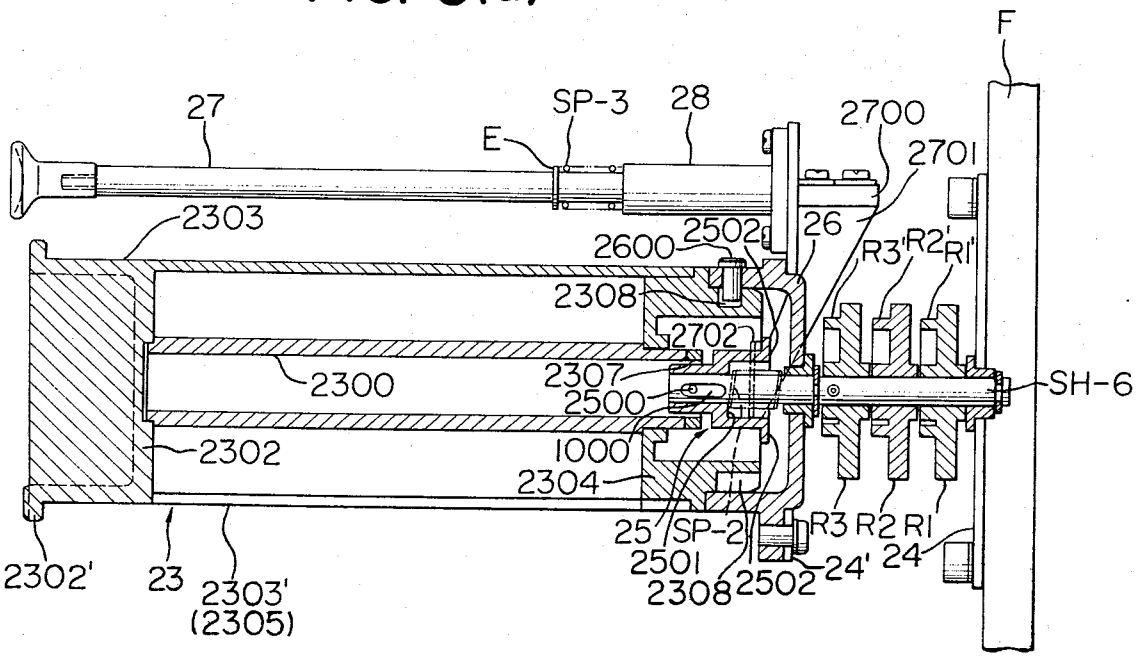
FIG. 8 schematically shows a toner supply container and its driving mechanism; specifically, FIG. 8 (*a*) is a front view of the container and the mechanism partially in section and FIG. 8 (*b*) is a side view of the container and the mechanism.
Figure 8B:
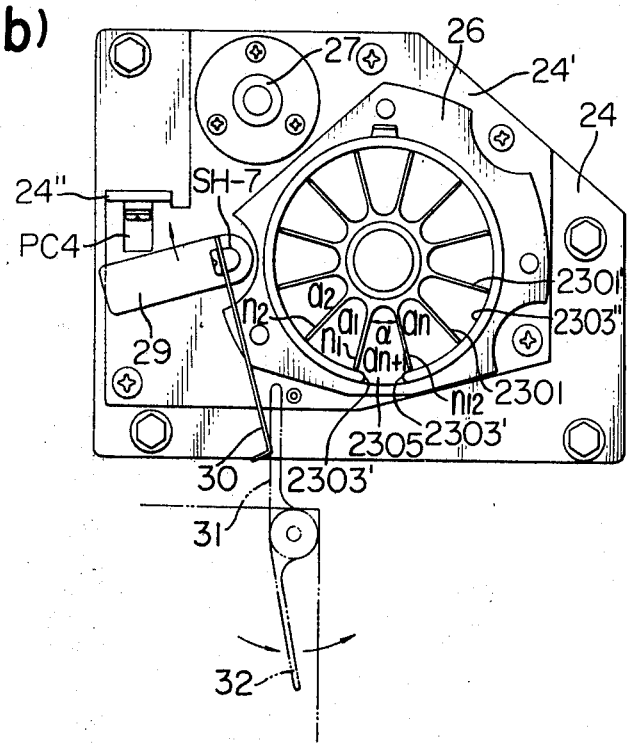

FIGS. 8 (*a*) and 8 (*b*) show the toner supply container 23 set in a given position of the machine. In FIG. 8 (*a*), however, blades 2301 are omitted. The toner supply container 23 is molded of a resin material such as, for example, acetal resin for example "DERLIN" (trademark by Dupont) or polyethylene resin which is resistant to the toner, and consists of a plurality of blades 2301 which define a plurality of partitions $a_1$–$a_{n+1}$ equiangularly divided around a hollow core 2300, a hollow sleeve 2303 enclosing the blades 2301 and provided with a side wall 2302 to which one end of the core 2300 is secured, and a lid 2304 fitted in the free end of the hollow sleeve 2302 and clamping the other end of the core 2300 and enclosing the entire blades 2301. Connection of the ends of the core 2300 to the side wall 2302 of the sleeve 2303 and the lid 2304 is attained only by pressing the ends of the core into the side wall and the lid by the use of the elasticity of the resin material. The hollow sleeve 2303 is provided on its part of the periphery with a narrow opening which permits the toner stored in the partitions $a_1$–$a_{n+1}$ to fall into the developing device 22. A larger diameter portion 2302' is formed on one end of the sleeve 2303 for an operator to put the toner supply container 23 into the machine and take it out of the machine with ease. The edge 2303' of the opening 2305 is formed so as to project further inward than the imaginary inner periphery of the opening provided by continuity of the inner peripheral surface 2303'' of the sleeve 2303. The inner space of the hollow sleeve 2303 is uniformly divided into a plurality of partitions by a plurality of blades 2301 which extends radially in section out of the core 2300 as shown in FIG. 8 (*b*) and extends longitudinally of the hollow sleeve 2303 as shown hereinbefore. In the embodiment, each of the partitions thus defined is filled with toner powder, and the length of the blade is selected so that the outer end 2301' of the blade substantially touches the inner peripheral surface 2303'' of the hollow sleeve 2303 to prevent the toner powder from entering any other partitions. The clearance between the inner surface of the side wall 2302 or the lid 2304 and the blade 2301 opposite is so formed that the toner will not leak out of the clearance. When explanation is given to the blade 2301 with reference symbols $n_1$ to $n_{12}$ added thereto as shown in FIG. 8 (*b*), the angle $\alpha$ made by two adjacent blades—for example, a blade $n_1$ and another blade $n_{12}$—is so selected that the outer ends of these two blades are spread enough to straddle the opening 2305.

With the toner supply container 23 constructed as described above, after the partitions $a_1$ to $a_n$ are filled with toner, it is possible to supply a substantially constant amount of toner into the developing device 22 by turning the blades a given angle at a time in association with copying operation. The partitions are filled with toner except the partition $a_{n+1}$ which is positioned just in alignment with the opening 2305. The toner supply container 23 can be carried about without fear of scattering of the toner. In addition, a conventional toner container functions merely to accommodate the toner and is housed in a copying machine. However, the toner supply container according to the embodiment of the invention, functions to supply the toner as well as performing the same function as the conventional toner container. It is known that fluidity of the toner varies with change in humidity. However, each partition of the toner supply container is sealed in the embodiment and is of small volume, and therefore the adverse effect caused by the change in humidity can be prevented completely in comparison with the toner supply attained by the conventional machine. A mechanism for driving the blades 2301 inside the toner supply container is described hereinafter.

Operation of the toner supply container will now be described with reference to FIGS. 9 (*a*) to 9 (*d*) of the drawings.

Figure 9:
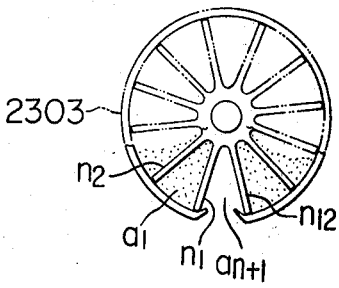
FIG. 9 shows the operation of the toner supply container at respective stages.
Figure 9:
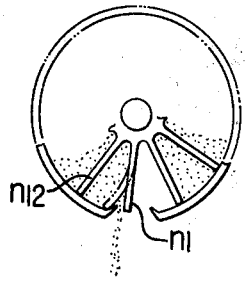
Figure 9:
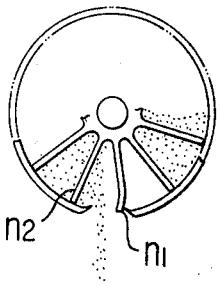
Figure 9:
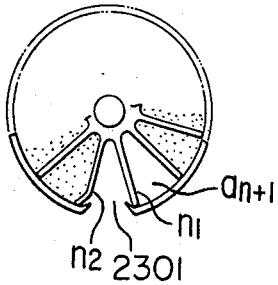

FIG. 9 (*a*) shows the toner supply container in the state prior to supply of the toner. The toner is stored in the respective partitions defined by a pair of blades $n_1$ and $n_{12}$ partially defining the partition $a_{n+1}$ and the peripheral edge 2303' of the container, and is kept from the influence of change in humidity. FIG. 9 (*b*) shows the initial state of rotation of the blades 2301 wherein the outer end of the blade $n_1$ touches the edge 2303' projecting inwards from the inner peripheral surface of the hollow sleeve 2303, and is bent as shown in the drawing by the two-dot chain line. As the blades 2301 go on to turn, the blade $n_1$ moves over the edge 2303'. In this instant, the kinetic energy stored in the blade $n_1$ by the bending thereof will cause the blade $n_1$ to leap, so that the toner will begin to fall through the opening 2305. FIG. 9 (*c*) shows the blades 2301 in a state of further rotation. The blade $n_1$ is again bent by the right hand side edge 2303' of the container and caused to leap, and then restored as shown in FIG. 9 (*d*). At this very instant, the blade $n_2$ is a little bent by the left hand side edge 2303' as shown in FIG. 9 (*d*). The toner stored in the remaining partitions is sealed so as not to be subjected to the substantial influence of humidity. Thereafter, the same operation is repeated in synchronism with the copying operation. The amount of the toner to be supplied can be controlled by adjustment of rotation speed of the blade. In the foregoing, the inwardly bent edge has been described by way of example: however, the same effect can be attained by the provision of a projection in the vicinity of the edge of the container. The bent portion or the projection needs not necessarily be provided, and such function as described above can be maintained by forming the blades of a rigid body. Regardless of existence of the bent portion or the projection, if the blades are formed of elastic materials as mentioned above, and the length of the blades is selected so that the outer end thereof extends beyond the inner diameter of the hollow sleeve 2303, the required resilience is obtained. Moreover the toner inside the partitions $a_1$–$a_n$ can easily be protected from humidity change.

Explanation will now be given to a retaining mechanism and a driving mechanism of the toner supply container 23 in connection therewith. Referring to FIG. 8, mounting plates 24, 24', united together but with little space therebetween, are attached to the frame F. Between the mounting plates 24, 24' there is rotatably supported a shaft SH-6 having three ratchet wheels R1, R2 and R3 thereon. The first ratchet wheel R1 and the second ratchet wheel R2 are loosely mounted on the shaft SH-6 and the third ratchet wheel R3 is only fixed to the shaft SH-6. These three ratchet wheels have the following relation to the blades 2301. Namely, the first ratchet wheel R1 is angularly advanced tooth by tooth by means of another ratchet (not shown) mounted on a shaft SH-7, as hereinafter described, for every copying operation and, upon one revolution of the first ratchet R1, the latter will advance the second ratchet wheel R2 by one tooth. When the repetition of such an operation causes one revolution of the second ratchet wheel R2, the latter is associated with the third ratchet wheel R3 to angularly advance it by one tooth. The turning of the third ratchet wheel R3 will cause rotation of the core 2300 or the blades 2301 by a given amount. In order to meet such requirement, bosses R1', R2' and R3' of the ratchet wheels R1, R2 and R3 are formed as eccentric cams with respect to the shaft SH-6. There are three ratchets provided opposite to the ratchet wheels R1, R2 and R3. The ratchet associated with the second ratchet wheel R2 is engaged with the plate (not shown) disposed to receive the power from the boss R1' of the first ratchet wheel R1 and the ratchet associated with the third ratchet R3 is engaged with an additional plate (not shown) disposed to receive the power from the boss R2' of the second ratchet wheel R2. The three ratchets R1', R2' and R3' are of course always energized in such a direction, so as to make contact with the ratchet wheels R1, R2 and R3, respectively.

One end of the shaft SH-6 extends through the mounting plate 24' and has a hollow stepped latch member 25 at the other end. The shaft SH-6 is provided with a slot 1000 at the situation of the latch member 25. The latch member 25 is held on the shaft SH-6 by a pin 2500 of a predetermined length and is always located at the end of the shaft SH-6 by a biasing force of a spring SP-2 arranged between one of the bearings and the internal end surface of the latch member 25. It will be understood that the latch member 25 is slidable on the shaft SH-6 by a distance which is a little shorter than the slot 1000. The pin 2500 is adapted to engage with a split groove 2307 formed on the end of the core 2300 to provide rotational power substantially on the blades inside the toner supply container. A cylindrical retaining member 26 having the lid 2304 fitted therein is secured to the mounting plate 24' as shown in FIG. 8 (*a*) to retain the toner supply container 23 like a cantilever. On the upper side of the retaining member 26, there is studded a pin 2600 which engages with the groove 2308 formed over the area of approximate 180 degrees of the periphery of the lid 2304 to both regulate and maintain the position of the toner supply container 23. In the embodiment, the toner supply container 23 is loaded into the retaining member 26 with the opening 2305 thereof oriented right above. After the pin 2600 is engaged with the groove (or the lower portion of the groove 2308 shown in the drawing) and the pin 2500 is engaged with the split groove 2307, the container 23 is turned clockwise by a half revolution to complete the loading of the container 23.

In this way, the toner supply container 23 is retained in a normal position with the opening 2305 opposed to the recess (opening) 2204 of the developing device 22 as shown in FIG. 2. A lever 27 is provided for releasing locking of the pin 2500 and the split groove 2307 of the core 2300. The lever passes through the mounting plates 24'. On the portion 2700 of the lever which extends beyond the mounting plate 24', there is attached an arm 2701 with a tip 2702 which reaches the inside of the retaining member 26 and hooks the jaw 2502 of the latch member 25. In the drawing, particularly FIG. 8 (*a*), only one arm 2701 is shown. However, there is another arm on the opposite side of the arm 2701 with respect to the lever 27. It is needless to say that the tip of the arm is hooked by the jaw 2502 of the latch member 25 similarly to the tip of the arm. A spring SP-3 is disposed on the lever 27 between an E shaped ring E and the sleeve 28, and always biases the lever 27 to the left. With the releasing mechanism constructed as above, if it is desired to disengage the toner supply container 23 loaded in the machine, the lever 27 is moved to the right to cause the latch member 25 to move to the right by means of the tip of the arm 2701 which moves with the movement of the lever 27, so that engagement of the pin 2500 with the split groove 2307 is released. After that, the toner supply container 23 is turned in the opposite direction (counterclockwise) to return the relationship of the pin 2600 and the groove, to that taken before the insertion of the container, and is then pulled to the operator's side (leftward in FIG. 8 (*a*)). A photocoupler (or photo-sensor) consisting of, for example, a light emitting diode and a photo-transistor PC4 is provided on the bent portion 24'' of the mounting plate 24' as shown in FIG. 8 (*b*). A first lever 29 is fixed mounted on one end of the rotatable shaft SH-7 extending between the mounting plates 24 and 24' and is able to swing about the shaft SH-7. The amount of swing is set to be so as to intercept the light path of the photo-coupler PC4. The second lever 30 is formed by bending a part of the first lever 29 and is arranged so that a part of the lever 30 is always in contact with a third lever 31 shown by a two-dot chain line rotatably mounted on the body of the machine. A fourth lever 32 is integrally attached to the third lever 31 so as to be able to turn therewith by the same amount in the same direction. The fourth lever 32 has such a length as to reach the transfer path of a copying sheet and is subjected to the turning force from the copying sheet and transmits the force to the first lever 29 and the shaft SH-7.

It is for this very reason to obtain the structure as described above, that a thick sheet of small size is used as a copying sheet 500 in the embodiment of the invention. In case it is desired to use it with the copying machine of the invention, a thin copying sheet such as plain paper as used in a conventional copying machine, may need to be modified. The fourth lever 32 has substantially two different functions. One of the functions is to turn the shaft SH-7 through the third lever 31, and the second lever 30 with the result that the first ratchet R1 is advanced tooth by tooth by means of the ratchets (not shown) associated with the ratchet wheels R1, R2 and R3 on the shaft SH-7. In other words, the first function of the fourth lever 32 is the one as a driving source. The turning of the first ratchet wheel R1 means that the blades 2301 of the toner supply container 23 are eventually rotated through the third ratchet wheel R3 to effect the toner supply. Another function of the fourth lever 32 is to act to turn the first lever 29 counterclockwise to intercept the light path of the photo-coupler PC4 and the output of the photo-transistor thus obtained is used to start movement of the copy board 2 or to energize the solenoid SOL-1. In the foregoing description of movement of the copy board 2, it was set forth that the solenoid SOL-1 and the motor M are actuated directly by the depression of the printing button; however, the details of operation are as described hereinbefore. It is of course possible to construct the machine as described above depending upon various factors of design such as travelling speed of a copying sheet 500, distance between the storing position for the copying sheet and the stopper 37, speed of movement of the copy board, and distance from the front edge of the original mount to the area illuminated by the light source for exposure and etc.

A sheet supply device 33 includes a sheet supply means 3300 mounted on a shaft SH-8 which means 3300 consists of rubber rollers in the form of a ring. The sheet supply means 3300 takes to first position where the means is in pressure-contact with the lowermost sheet of the copying sheets accumulated on a mount 34 inside the hopper H, and the second position where the means is separated from the lowermost. The sheet supply means 3300 is coupled to a solenoid (not shown) through an arm 35 so that the means can swing around the shaft SH-9 as a fulcrum between the first and the second positions. There is provided at the rear side of the shaft SH-8 a gear (not shown) which is arranged to be in mesh with a gear (not shown) secured on the shaft SH-10 of a pinch roller 35 (*a*) through an intermediate gear provided on the shaft SH-9. The shaft SH-10 extends through the frame F. On the end of the shaft SH-10 is mounted a sprocket S3 which is adapted to be driven by the motor M through a chain (see FIG. 13).

Figure 10:
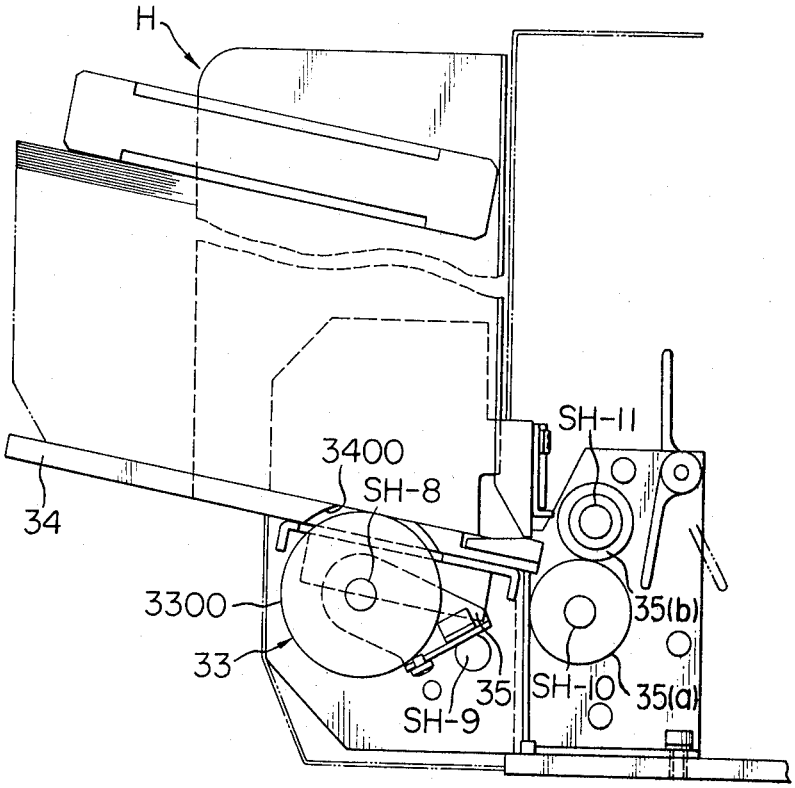
FIG. 10 shows a sheet supply device of the machine.
Figure 13:
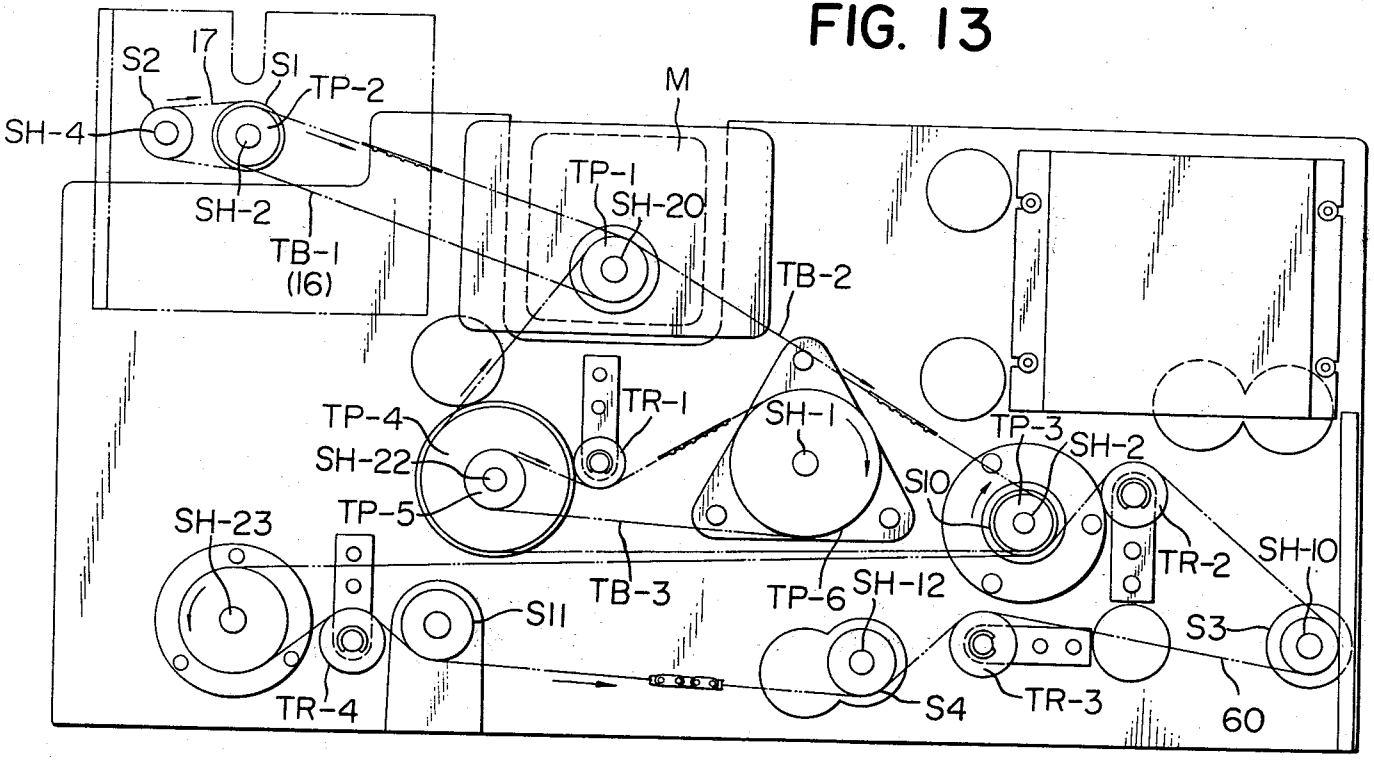
FIG. 13 schematically shows a path of driving power transmission of the machine.

As will be understood from the foregoing, no means such as a clutch for shutting off mechanical power is provided in the power transmission path from the motor M to the pinch roller 35 (*a*) and the sheet supply roller 3300, as is the case with the power transmission path from the motor M to other movable members. This is intended for extreme simplification of the mechanism of the machine and is based upon the ground that the amount of consumption of electric power is not changed even if the supply roller 3300 is energized continuously during the period of operation of the motor M. As shown in FIG. 13, the sprocket S3 associated with the pinch roller 35 (*a*) engages with the chain driven by the motor M which is rotated by the depression of the printing button. The driving power is transmitted from the sprocket S3 to the sheet supply roller 3300 through the gear train. No driving motor exclusively used for sheet supply is needed as opposed to the conventional machine, because the load to the sheet supply roller is quite low. The mount 34 is provided with an opening 3400 through which the sheet supply roller 3300 is permitted to protrude above or retract a little below the upper surface of the mount 34 as will be understood from FIG. 10.

A pair of pinch rollers 35 (*a*) and 35 (*b*) are made of metal such as aluminum and brass or a rigid material such as ebonite. This is intended to solve the problem inherent to the conventional copying machine of this type that a thick sheet having a hole thereon such as, for example, a book card used as a copying sheet cannot make close contact with the surface of the photosensitive drum D due to unevenness of the area around the hole with the result that a toner image formed on the drum surface will not be transferred completely onto the thick sheet such as a book card. If such unevenness of the thick sheet can be removed, or a smooth surface condition can be obtained on the thick sheet, then either of the pair of pinch rollers 35 (*a*) and 35 (*b*) may be made of an elastic material. Alternatively, both of the pair of pinch rollers may be made of an elastic material. An experiment showed that hardness of the surface of the pinch roller was perferably greater than 70 degrees. If it is desired to feed the copying sheet 500 without any slip, it is desirable that the surface of either of the pinch roller is made of a material whose coefficient of friction is rather high. Both of the pinch rollers 35 (*a*) and 35 (*b*) may be biased by a spring or the like to provide a required pressure force. Alternatively, such pressure force may be attained by maintaining the shafts SH-10 and SH-11 of both pinch rollers 35 (*a*) and 35 (*b*) stationary so that the gap provided between these rollers is made narrow by a given amount as compared with the thickness of the copying sheet as the thick sheet to be used. In this case, it is possible to maintain the upper pinch roller 35 (*b*) stationary until the copying sheet comes between the pinch rollers 35 (*a*) and 35 (*b*). Namely, when the copying sheet comes between the pinch rollers 35 (*a*) and 35 (*b*), the upper pinch roller 35 (*b*) which is not connected to the driving mechanism will follow the lower pinch roller 35 (*a*) with the result that a required pressure force will be applied to the copying sheet 500. The pressure force to which the copying sheet is subjected will change in proportion to the thickness of the copying sheet provided that the gap between the rollers is made constant. Therefore, in case several kinds of copying sheets having different thickness are used, the gap should be sized in association with the minimum thickness among the copying sheets so that a given pressure force can be applied to every copying sheet to attain the purpose as mentioned above. If the upper pinch roller 35 (*b*) and the lower pinch roller 35 (*a*) are so positioned that they are elastically pressure-contacted with each other under the condition that the maximum distance between the rollers is limited, the copying machine can be used regardless of thickness of the copying sheet. The surface of the pinch rollers 35 (*a*) and 35 (*b*) need not be of hardness higher than 70 degrees for a copying sheet with no hole thereon, and may be rubber rollers conventionally used as a carrying roller.

Figure 11A:
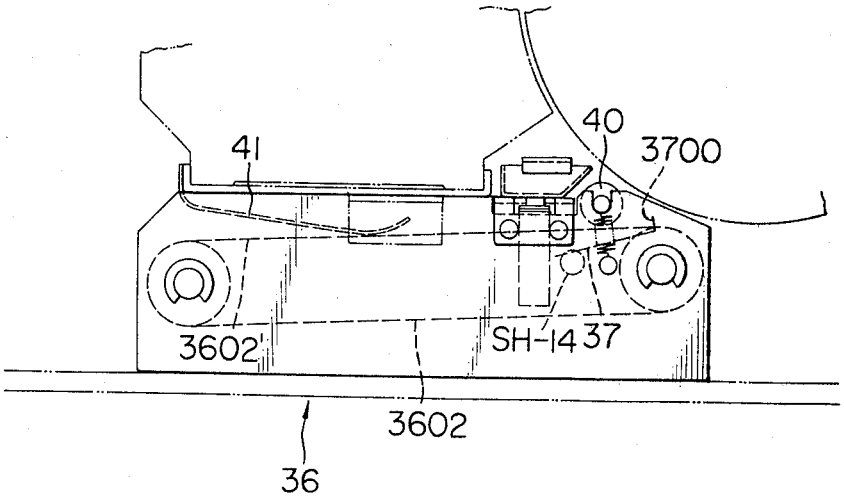
FIG. 11 shows the first carrying device of the machine; specifically, FIG. 11 (*a*) is a side view of the carrying device and FIG. 11 (*b*) is a top view of the carrying device.
Figure 11B:
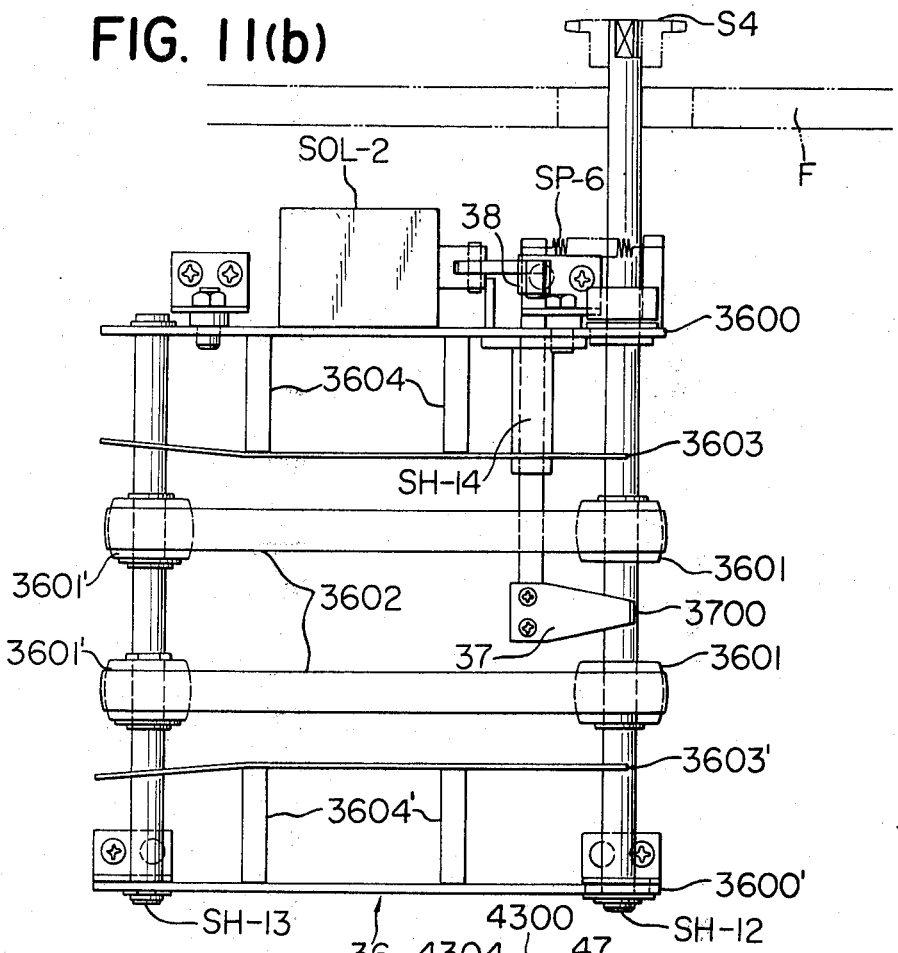

The copying sheet 500 thus fed is carried towards a transfer device 39 by means of a first carrying means 36. Referring to FIG. 11 (*b*), the shafts SH-12 and SH-13 extend in parallel to each other between a pair of side plates 3600 and 3600'. One end of the shaft SH-12 extends beyond the frame F and the power is directly transmitted to the shaft SH-12 from the motor M through a sprocket S4. A plurality of rollers 3601 and 3601' are mounted at opposite positions on both of these shafts SH-12 and SH-13. A carrying belt 3602 is stretched between the rollers 3601 and 3601' as shown in FIG. 11 (*a*). Between the side plates 3600 and 3600' are disposed a pair of guide plates 3603 and 3603' through stays 3604 and 3604' so as to be associated with the upper surface 3602' of the belt 3602 which provides a moving path for the copying sheet. Needless to say, the purpose of guide plates is to avoid bending of the copying sheet 500 during movement thereof which may cause failure of operation of the machine, and to control transfer of the toner image formed on the photosensitive drum D onto a predetermined position (the position determined widthwise on the copying sheet) of the copying sheet. A stopper 37 is disposed inside the region of the first carrying means 36 and downstream thereof (at the side of the transfer device) as viewed in the direction of movement of the copying sheet. The stopper 37 is fixedly mounted on the end of the shaft SH-14 which is engaged at its end with the armature of a solenoid SOL-2 through a plate 38. The stopper 37 is arranged in such a manner that, when the solenoid SOL-2 is in its deenergized condition, the stopper 37 has its bent portion 3700 projecting from the upper surface 3602' of the carrying belt forming the path of movement of the copying sheet as shown in FIG. 11 (*a*) of the drawings while, when the solenoid SOL-2 is in an energized condition, the stopper 37 will turn clockwise around the shaft SH-14 so that the bent portion 3700 will take a retracted position from the path of movement of the copying sheet while the solenoid SOL-2 is being energized. A spring SP-6 is provided to cause the former condition. The stopper 37 which is adapted to allow its bent portion 37 to protrude above the path of movement of the copying sheet has such function so as to bring into a temporary waiting condition on a rotating belt, the copying sheet 500 carried by the supply roller 3300, a pair of pinch rollers 35 (*a*) and 35 (*b*), and the carrying belt 3602, by causing the front edge of the copying sheet to hit against the stopper 37 as a result of the depression of the printing button.

When the copy board 2 is detected by the photo-coupler PC1 arranged on the path of movement of the copy board 2, the stopper 37 will turn in response to energization of the solenoid SOL-2 caused by the detection signal and retract from the position as described above, to permit thereby retransporation of the copying machine which has been in a waiting condition. The time of reenergization of the copying sheet or the time of retraction of the stopper 37 is such time that the overlap of the copying sheet with the drum can exactly be maintained so that the toner image on the photosensitive drum D is always brought into a predetermined position of the copying sheet.

Prior to discussion of the advantages obtained from the embodiment constructed in this manner, an explanation will be given to a conventional synchronized carrying system. By way of example, a printing button is associated with a copying sheet feeding roller such that upon depression of the printing button the feeding roller will be actuated to feed a piece of copying sheet from a sheet tray. A plurality of pairs of carrying rollers arranged along the path of movement of the copying sheet between the sheet tray and a given position (the waiting position) remain rotating while a pair of carrying rollers located at the given position do not actuate, but are rotated by means of an electromagnetic clutch when, for example, the moving optical system switches on (synchronous signal) the micro-switch arranged on the travelling path of the optical system. A second micro-switch is provided in the vicinity of the pair of carrying rollers located at the given position and adapted to control the pairs of carrying rollers located downstream of the predetermined position to be inoperable when the front edge of the copying sheet is detected by the second micro-switch.

In operation, when the copying button is depressed, the feed roller will operate to feed a part of copying sheets accumulated in the tray into the carrying path. The pairs of carrying rollers located between the tray and the predetermined position are already rotating, so that the copying sheet is carried to the predetermined position while being pinched. When the copying sheet approaches the predetermined position, the micro-switch will detect the front edge of the copying sheet. An output from the micro-switch is effective to make the pairs of carrying rollers in the region as described above, inoperable through an appropriate control circuit. It is to be noted, however, that the pairs of carrying rollers, while being electrically inoperable, continues to be rotating due to their inertia and acts on the copying machine with the help of their amount of rotation so that the front edge of the copying sheet is brought between the pair of carrying roller located in the predetermined position which is in an inoperable condition. On the other hand, the moving optical system switches on the micro-switch located on its travelling path, and the resulting output signal will actuate the electromagnetic clutch, so that the pair of carrying roller pinching the front edge of the copying sheet is actuated to carry the copying sheet which has been in a waiting condition. However, in such a synchronous carrying method or structure as discussed above, a pair of rotating rollers are energized intermittently by means of an electromagnetic clutch and consequently there is a drawback, in that the waiting position of the copying sheet differs each time due to various factors such as inertia of the rollers and building-up of restarting speed which does not remain constant. This means that position of the image to be formed in the predetermined area on the copying sheet is not fixed constantly. Such unstable formation of the image has no significant influence on an ordinary copying machine. However the image thus formed will become quite unsightly for a copying sheet of small size such as a book card or a name card which is not used for usual copying.

It is intended in the embodiment of the invention as described above to avoid these drawbacks, to obtain an exact control or effects so that superposition of the image region on the photosensitive body upon the copying sheet can be maintained all the time, even if use is limited. In the structure described above, the stopper 37 need not necessarily be provided on the first carrying means and may be positioned anywhere on the carrying path to the transfer device 39, if it is able to support the copying sheet and synchronism is assured as discussed above. The width and the shape of the stopper and in particular the bent portion thereof for stopping the front edge of the copying sheet can properly be determined. Alternatively, a synchronous signal (the output signal of the detection means PC1 in the embodiment) may be picked up photoelectrically from, for example, the developed image. In consideration of the significant feature of the present invention that the power transmission mechanism for the sheet supply means is directly coupled to the output shaft of the motor M, it is to be understood that control of the operation of the carrying belt 3602 in terms of time will not depart from the intent of the invention. More particularly, the carrying belt 3602 may be controlled to become inoperable after the front edge of the transfer sheet 500 hits on the bent portion of the stopper and to become operable again in response to the output signal (synchronous signal) of the photocoupler PC1 before the stopper 37, and hence its bent portion 3700, retracts from the carrying path. In this way, if control is performed to assure that the copying sheet will hit on the bent portion of the stopper 37 before re-transportation of the copying sheet, it is possible to keep the transfer sheet and the image region on the photosensitive drum in a constant relation with each other all the time. This results in the effects that the copying sheet can be re-transported in a stable condition just like the case where the carrying belt is always moving, in contrast to the case where initial condition of movement is used for transportation of the copying sheet, as the initial movement of the carrying belt is not used.

Referring to FIG. 11 (*a*), it will be seen that there is provided a front edge pressing roller 40 for preventing the lift of the copying sheet which is in engagement with the stopper 37 and a rear edge pressing plate 41 made of an elastic plate. These members may be removed if the carrying belt moves smoothly.

When the solenoid SOL-2 is energized in response to the synchronous signal (the output signal of PC1) and the stopper retracts to its retracted position, the transportation path for the copying sheet is opened with the result that the copying sheet which has been in a waiting condition will pass the transfer device 39 under the condition that it is superposed on the toner image region on the photosensitive drum D. The toner image on the photosensitive drum D is transferred onto the copying sheet with the help of the electric field established between the wire electrode w1 (see FIG. 2) and the support of the photosensitive drum D. Thereafter, the copying sheet will gradually separate from the periphery of the photosensitive drum D by its own regidity and be carried towards the fixing device 43 by the second carrying means 42. The structure of the transfer device 39 is identical with that of the charging device 3 for interchangeability. The second carrying means 42 is also substantially like the first carrying means 36 except the stopper 37 itself and the members associated therewith. Therefore, further explanation of this particular carrying means is omitted. In case a thin copying sheet such as plain paper is used, it is possible to separate the copying sheet from the periphery of the photosensitive drum by means of a conventional separation means just after transfer processing.

Figure 12:
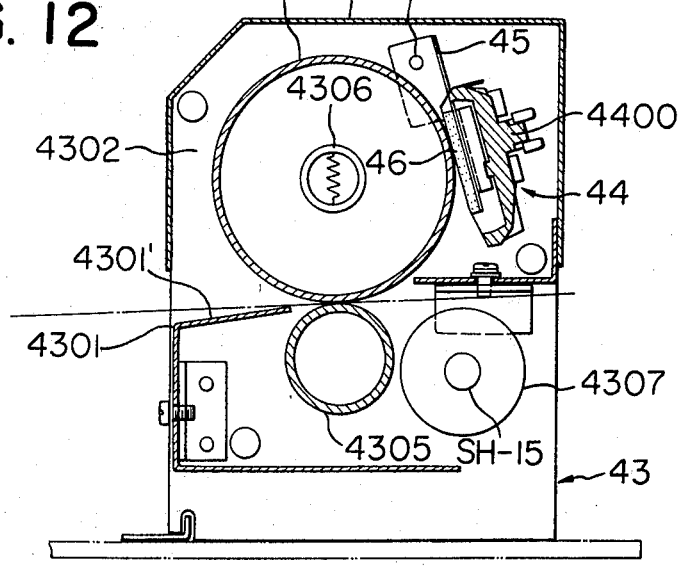
FIG. 12 is a sectional view of a fixing device of the machine.

As is seen from FIG. 12, a fixing device of a roller type is used as a fixing device 43 of the embodiment for the reason that it has a high thermal efficiency and there is little danger of firing with the fixing device of this type. Now the fixing device 43 as shown in FIG. 12 will operate as follows. A pair of rollers 4304 and 4305 are enclosed by an upper casing 4300 and a lower casing 4301 provided between the side walls 4302 (only one of which is shown in FIG. 12), so as to prevent entry of the outside air. A part of the lower casing 4301 is inclined with respect to the horizontal surface to guide the copying sheet. The path of movement of the copying sheet is shown by a chain line. The upper roller 4304 comprises a heating roller which has in its hollow interior a heating element 4306 consisting of, for example, a halogen lamp, and has on its surface a film made of resin such as, for example (poly-) tetrafluoroethylene which should have non-sticking property to the toner. The other roller 4305 is a pressure roller which is hollow and has on its surface a coating having a good non-sticking property to the toner like the heating roller 4304. The heating roller 4304 has a larger diameter and a larger hollow space therein than the pressure roller 4305 from the standpoint of heat conservation and dischargeability of the copying sheet. The outer of both roller shafts is shifted so that the copying sheet fed between the rollers slightly upwards is moved forward straight as it is.

In a conventional roller fixing device, both rollers are arranged so that they make pressure-contact with each other and so that the pressure roller will have a considerably larger deformation on its surface as compared with the deformation of the heating roller. However, in the embodiment of the invention, both rollers are not arranged to be in pressure-contact with each other on the basis of the conventional fixing device, and they are set in such a manner that the amount of deformation at the contact portion of the two rollers will be substantially equal. Substantial equal amount of deformation is intended to maintain the copying sheet in a plain state. In more detail, there is little problem for a thin copying sheet. However, in case a thick copying sheet such as a book card, an IBM card and a name card is conducted between the conventional pair of rollers having the structure as described above, and is allowed to pass, the copying sheet will become curved inevitably along the curved periphery of the heating roller 4304 and will never return to its initial flat state. This will cause difficulty in handling and poor appearance of the copying sheet. Substantial equal amount of deformation has been employed in the embodiment according to the invention to remove these drawbacks. In practice, the rollers 4304 and 4305 are hollow metal rollers made of aluminum or the like, and on which there is provided a layer of elastic material with thickness of about 1 mm consisting of a silicone rubber. A tube having the thickness of 0.5 mm consisting of tetrafluoroethylene is thermally shrinked on the elastic material of the roller. The structure of the roller and the thickness of the components may properly be changed. For example, sufficient amount of deformation can be obtained to attain the purpose as described above, by constituting the pressure roller 4305 of a metal roller and coating of silicone rubber thereon.

In the embodiment, the rollers 4304 and 4305 are spaced so that a gap of 0.2 mm to 0.5 mm is left between the opposite parts on the peripheral surfaces of the rollers and that, when the heating element 4306 disposed inside, the heating roller 4304 is energized upon switching on of the main switch of the machine and the machine becomes ready for copying operation. The heating roller 4304 is in little contact with or appreciably apart from the pressure roller 4305. The gap thus provided must, of course, be smaller than the thickness of the copying sheet to be used. The rollers are thus in the condition of light pressure contact with each other. More particularly, "the condition of light pressure contact" means that, when the pressure roller is rotating in contact with the driven heating roller with no copying sheet present therebetween, the pressure roller can be stopped by application of a slight force thereto and on the other hand the heating roller can be rotated while rubbing the pressure roller. In this respect, the relation of the heating roller 4304 to the pressure roller 4305 is like that of the pair of pinch rollers 35 (*a*) and 35 (*b*). Therefore, if it is desired to use copying sheets of different thickness, it is possible to apply sufficient heat and pressure to melt the toner satisfactorily depending upon the thickness of the copying sheets, by positioning the two rollers to provide a little smaller gap therebetween than the thickness of the copying sheet having the smallest thickness. With the structure as described above, no braking mechanism is required to bring the pressure roller into pressure contact with the heating roller in contrast to the conventional copying machine, and the structure of the machine can be simplified and the mounting of the rollers can be made easier. Moreover, there is no impact or shock caused by pressure contact of the rollers, and no adverse effect is imposed upon the heating element 4306. The copying sheet which has passed between the rollers is discharged out of the machine by a sheet discharging roller 4307 located downstream of the pressure roller 4305. The shaft SH-15 of the sheet discharging roller 4307 extends beyond the side wall 4302 at its rear end, and terminates in front of the frame F. On the rear end of the shaft SH-15 is mounted a gear (not shown) which is adapted to be in mesh with a gear mounted on the end of the shaft of the heating roller 4304. There are provided two projections on the center of the shaft on the plane inside of the effective diameter of the gear mounted on the end of the shaft SH-15, and these projections engage with projection on the end of the shaft (not shown) which is adapted to receive the power directly from the motor M, to provide a so-called coupling. The motor is arranged to be energized by the depression of the printing button and therefore, at the time of energization of the heating element 4306 by the ON signal of the main switch, the heating roller 4304 remains stationary. This results in the effect that no air stream is produced around the roller and no heat loss occurs as compared with the conventional device in which a heating roller together with carrying system is rotated (during the time period of warming up of the machine) upon switch on of the main switch. It is also an advantage that no noise produced, as no power is applied to both of the rollers for rotation.

There is provided a temperature detecting device 44 for detecting the surface temperature of the heating roller 4304. This device is connected to a control circuit (not shown) intended to control electrical conduction to the heating element 4306. The temperature detecting device 4 consists of a support 4400 made of an insulating material and a thermocouple 4401, for example Alumel-Chromel thermocouple, wound around the support 4400. The support 4400 is swingingly supported by a support plate 45 with respect to the side wall 4302. A part of the support plate 45 is bent to extend into the space defined by the thermocouple 4401 and the support 4400, and has a cushion member 46 such as a felt or the like in the area opposed to the thermocouple 4401. The function of the cushion member 46 is to assure that the thermocouple 4401 contacts with the surface of the heating roller 4304, when the temperature detecting device 44 turns around the pivot 47 by its own weight. With the structure as described above, after completion of transfer processing, when the copying sheet separated from the photosensitive drum D goes between the heating roller 4304 and the pressure roller 4305 through the second carrying means and the guide portion 4301' of the lower casing 4301, both the rollers 4304 and 4305 will carry the copying sheet while applying required heat and pressure thereto to melt the toner thereon. Thereafter, the copying sheet passes the discharge roller 4307 and is received by the tray T. The tray T is angularly moved by an operator as shown in FIG. 1, by arrows so that the copying sheets can be put on angularly different positions as desired, by angularly changing the position of the tray T.

Turning again to FIG. 2 of the drawing, it will be noted that an electric charge removing device 48 is positioned adjacently to the periphery of the photosensitive drum D between the transfer device 39 and the cleaning device 49. The charge removing device 48 has a similar structure to that of the charging device 3 or the transfer device 39 and it functions to remove the potential of the toner electrostatically attracted to the surface of the photosensitive drum D and the residual potential of the drum surface, after transfer of the toner image onto the drum surface, to improve cleaning efficiency of the residual toner, as is well-known in the prior art. The cleaning device 49 extends in the direction of the width of the drum D and mainly consists of a blade 4900 with its lowermost end touching the drum surface and a casing 4910 for collecting the toner scraped from the drum surface by the blade 4900. It is preferred that the blade 4900 be made of an elastic material such as, for example, urethane rubber which does not hurt the drum surface and is easy to adapt itself to the drum surface. The plate 4901 supporting the blade 4900 is loosely supported with a plate 4903 affixed to the frame F at a point on substantially the center of the lengthwise direction of the blade 4903 by an engaging means 4902. Therefore, both sides of the blade 4900 integrally constructed with the plate 4901 can be moved opposite to each other towards and away from the surface of the photosensitive drum, as a center, at the point where the engaging means is positioned. Needless to say, however, the blade 4900 is constructed to make contact with the drum surface at its lower end or edge under uniform pressure, as will be understood from the function of the blade. The pressure acting on the drum surface is produced by the weight of the blade 4900 and the plate 4901. As a modified example, it is possible to apply a biasing force caused by a spring in one direction to the plate 4901 holding the blade 4900 to produce similar pressure force. Alternatively, it is also possible to employ a known method in which a blade is caused to slide back and forth to improve the life and cleaning efficiency of the blade. The casing 4910 is detachably mounted on a fixed rail of the frame F. There is provided a plate 4913, for prevention of toner falling, which has substantially the same length as the width of the photosensitive drum D and is disposed inside the casing for its front edge to make contact with the drum surface. With the structure as described above, the toner scraped from the drum surface by the blade 4900 will slip down the plate 4913 for prevention of toner falling, and be stored on the bottom of the casing 4910.

Reference will now be made to FIG. 13 to explain the power transmission path employed in the embodiment.

The motor M has an output shaft SH-20 which is rotated clockwise by the depression of the copying button. A timing pulley (or a timing gear) is fixedly mounted on the output shaft SH-20. An endless timing belt TB-1 is stretched between the timing pulley TP-1 and another timing pulley TP-2 mounted on the shaft SH-2. For the purpose of simplicity, the timing pulley and the timing belt are hereinafter merely referred to as "pulley" and "belt", respectively. The shaft SH-2 can constitute a power transmission means for moving the copy board 2. On the shaft SH-2, there is fixedly mounted a sprocket S1 which transmits the motive power to the shaft SH-4 through the chain 17 and the sprocket S2. The roller 12' for reciprocal movement of the copy board is associated with the shaft SH-4 as explained with reference to FIG. 6. Another belt TB-2 is wound on the pulley TP-1 and is stretched to a pulley TP-3 of reduced diameter fixed on the shaft SH-21 designed to rotate the sleeve of the developing device 22, and it is also stretched to a pulley TP-4 for reduction of speed provided on the intermediate shaft SH-22. A third belt TB-3 is stretched between the pulley TP-5 mounted on the intermediate shaft SH-5 and a pulley SP-6 mounted on the shaft SH-1 of the photosensitive drum. A tension roller TR-1 is provided to apply proper tension to the belt 3. The chain 60 is stretched to the sprockets arranged on given shafts so as to drive supply and carrying systems of the copying sheet. A sprocket S10 is fixedly mounted on the shaft SH-21 which will cause the sleeve of the developing device to rotate. The sprocket S3 is fixedly mounted on the shaft SH-10 associated with the pinch roller 35 (*a*) shown in FIG. 2. A sprocket S4 is fixedly mounted on the shaft SH-12 which is a component of the first carrying means 36. There is provided a sprocket S11 mounted on the shaft holding a roller for stretching the carrying belt in the second carrying means 42.

In the fixing device, a sprocket is fixedly mounted on the shaft SH-23 having one coupling member to transmit the motive power (which will eventually cause the heating roller to rotate as mentioned hereinbefore) to the shaft SH-15 of the discharge roller through a coupling (not shown). The chain 60 is stretched to a plurality of sprockets through tension rollers TR-2 and TR-3 as shown in the drawings. With the structure as described above, upon clockwise rotation of the motor M, the motive power is transmitted to the roller 12 for moving the copy board 2 forward through the belts TB-1 (16) and the shaft SH-2. The solenoid SOL-1 is energized as described above, a predetermined time after energization of the motor M to cause the roller 12 to make contact with the lower side of the holding frame 200. At this moment, when the chain 17 and the sprocket S2 is in a position apart from the lower side of the holding frame 200 and when the solenoid SOL-1 is deenergized after forward movement of the copy board 2, the relation between the rollers 12, 12′, (for moving the copy board 2 backward) and the holding frame 200 will be reversed. On the other hand, the motive power transmitted to the belt TB-2 will rotate the sleeve 2201 of the developing device through the pulley TP-3 and a proper coupling, and it will also rotate the photosensitive drum D in the direction of the arrow, through the pulley TP-5 provided for reduction of speed, the belt TB-3, and the pulley TP-6. The rotational force of the sprocket S10 mounted on the shaft SH-2 is transmitted to the chain 60 and causes the pinch roller 35 (*a*) and the sheet supply roller 3300 to rotate through a known power transmission means. The first carrying means 36 and the second carrying means 42 are also caused to rotate in a given direction. At the same time, the heating roller 4304 is also rotated through the shaft SH-23 so that the machine will be ready for fixing to melt the toner transferred onto the copying sheet by the image forming operation.

As has been seen from the foregoing, the copying machine according to the invention requires no electric motor exclusively used for a sheet supply means and motive power required therefor is derived directly from the motor M. This results in simplicity of structure and control and compactness of the copying machine. Simplicity of structure and easy control of the machine are amplified when it is considered that there is no power intercepting means such as a clutch or the like as employed in the conventional copying machine between the sheet supply means, the copy board, the photosensitive drum, the carrying means or fixing means and the output shaft of the motor which is in the path of power transmission. Technical merits brought about by the respective components and the mechanisms of the copying machine of the present invention have been described enough and are not repeated. It is to be understood that the invention should not be limited to one embodiment described above, but can include any change or modification without departing from the scope of the appended claims.

What we claim is:

1. An electrophotographic copying machine of transfer type comprising, a reciprocating copy board on which an original to be copied is placed; sheet supply means energized to make intermittent contact with transfer sheet stored in a tray; carrying means for carrying the transfer sheet fed by said sheet supply means; a stopper provided in association with the carrying means for bringing the transfer sheet carried thereby into a temporary waiting condition on the carrying means; and two detection means for detecting the moving position of said copy board; said two detection means, the stopper, the copy board and sheet supply means being so related that, when the first detection means detects the position of the forwardly moving copy board to produce a first detection signal from its position where the stopper has been engaging with the front edge of the transfer sheet and afterwards when the second detection means detects the backwardly moving copy board to produce a second detection signal, the copy board is caused to move backwards in response to the second detection signal and in case of successive copying operation said second detection signal is used to reenergize said sheet supply means.

2. An electrophotographic copying machine as set forth in claim 1, including third detection means to detect the backward moving copy board to produce a third detection signal so that the copy board is stopped at a given position.

3. An electrophotographic copying machine as set forth in claim 2, which machine further comprises a fourth detection means disposed between the sheet supply means and the carrying means for detecting a transfer sheet fed along the transportation passage thereof to produce a fourth detection signal thereby to start the forward movement of the copy board.

4. An electrophotographic copying machine of transfer type comprising;

a main motor, a copy board on which an original to be copied is placed, an exposure lamp to which said original is exposed, a rotatable photosensitive element, a charging means for electrically charging the surface of said photosensitive element, an optical system for projecting a light reflected from said original onto said photosensitive element to form an electrostatic latent image thereon, a developing means for converting the electrostatic latent image to a visible toner image, a transfer means for transferring the toner image onto a transfer sheet, a sheet supply means for feeding the transfer sheet stored in a tray, a carrying means for carrying the transfer sheet fed by said sheet supply means, a fixing means for melting and fixing the toner image on the transfer sheet characterized in that said sheet supply means comprises a supply roller adapted to be movable between a first position where the supply roller is in contact with the transfer sheet and a second position where the supply roller is not in contact with the transfer sheet and said sheet supply means is driven by the main motor, a stopper movably provided in association with the carrying means for bringing the transfer sheet into a temporary waiting condition by causing the front edge of the transfer sheet to hit against the stopper to assure that the image area on the photosensitive element exactly overlaps with the transfer sheet and said stopper is retracted from the position in the transportation passage of the transfer sheet in response to a synchronous signal related to copying operation so as to allow re-transportation of the transfer sheet by means of said carrying means, said carrying means being still in its operative condition even when the transfer sheet is being stopped by the stopper.

5. An electrophotographic copying machine of transfer type comprising;

a main motor, a copy board on which an original to be copied is placed, an exposure lamp to which said original is exposed, a rotatable photosensitive element, a charging means for electrically charging the surface of said photosensitive element, an optical system for projecting a light reflected from said original onto said photosensitive element to form an electrostatic latent image thereon, a developing means for converting the electrostatic latent image to a visible toner image, a transfer means for transferring the toner image onto a transfer sheet, a sheet supply means for feeding the transfer sheet stored in a tray, a carrying means for carrying the transfer sheet fed by said sheet supply means, a fixing means for melting and fixing the toner image on the transfer sheet characterized in that said sheet supply means comprises a supply roller adapted to be movable between a first position where the supply roller is in contact with the transfer sheet and a second position where the supply roller is not in contact with the transfer sheet and said sheet supply means is driven by the main motor, a stopper movably provided in association with the carrying means for bringing the transfer sheet into a temporary waiting condition by causing the front edge of the transfer sheet to hit against the stopper to assure that the image area on the photosensitive element exactly overlaps with the transfer sheet and said stopper is retracted from the position in the transportation passage of the transfer sheet in response to a synchronous signal related to copying operation so as to allow re-transportation of the transfer sheet by means of said carrying means, said carrying means being in its operative condition prior to retraction of the stopper from the transportation passage of the transfer sheet in response to a synchronous signal related to copying operation.

6. In an electrophotographic copying machine of transfer type having;

a machine frame, a reciprocating copy board on which an original to be copied is placed, an exposure lamp to which the original is exposed, a rotatable photosensitive element, a charging means for electrically charging the surface of said photosensitive element, an optical system for projecting a light reflected from said original onto said photosensitive element to form an electrostatic latent image thereon, a developing mean for converting the electrostatic latent image to a visible toner image, a transfer means for transferring the toner image onto a transfer sheet, a sheet supply means for feeding the transfer sheet stored in a tray, a carrying means for carrying the transfer sheet fed by said sheet supply means, and a fixing means for melting and fixing the toner image on the transfer sheet, the improvement comprising supporting means at one side of said copying board and related thereto as viewed in the direction of its movement so as to permit reciprocating movement of said copying board with respect to the machine frame, said copy board being caused to reciprocate by means of friction rollers positioned so as to be able to make frictional contact with a part of the copy board, said friction rollers comprising at least one forward moving roller and at least one backward moving roller which are driven by said main motor and controlled in such a manner that either of said friction rollers is selectively brought into contact with said copy board is response to a synchronous signal related to copying operation.

7. An electrophotographic copying machine of transfer type comprising;

a copy board supported for reciprocating movement at one side thereof as viewed in the direction of the movement, a fixed optical system arranged below the copy board and including a lens, a photosensitive drum journalled to rotate at the same surface speed as that of the copy board, a hopper for storing thick transfer sheets of small size, a sheet supply roller disposed to make intermittent contact with the lowermost sheet of the transfer sheets stored in the hopper, a pair of pinch rollers disposed downstream of the sheet supply roller, a carrying means disposed to carry the transfer sheet fed through the sheet supply means and the pair of pinch rollers towards a transfer station and a stopper disposed to bring the transfer sheet into a temporary waiting condition on the carrying means, said carrying means comprising a pair of spaced rollers and a belt extending between said rollers.

* * * * *